United States Patent [19]

Rieben

[11] 4,231,696

[45] Nov. 4, 1980

[54] MULTI-FUNCTION END EFFECTOR

[75] Inventor: Stuart L. Rieben, Mt. Lebanon, Pa.

[73] Assignee: Westinghouse Electric Corp., Pittsburgh, Pa.

[21] Appl. No.: 915,411

[22] Filed: Jun. 14, 1978

[51] Int. Cl.[2] ..... B25J 9/00

[52] U.S. Cl. ..... 414/5; 29/568; 165/76; 414/589; 414/746; 414/749

[58] Field of Search ..... 414/1, 2, 4, 5, 589, 414/590, 749, 750, 746; 29/568; 294/90, 91; 165/76

[56] References Cited

U.S. PATENT DOCUMENTS

| | | | |
|---|---|---|---|
| 3,610,438 | 10/1971 | Opdahl | 414/738 |
| 3,913,752 | 10/1975 | Ward et al. | 165/76 X |
| 3,934,731 | 1/1976 | Müller et al. | 165/76 X |
| 4,004,698 | 1/1977 | Gebelin | 165/76 X |
| 4,018,346 | 4/1977 | Leshem et al. | 165/76 X |
| 4,148,403 | 6/1977 | Riffe | 414/2 |

OTHER PUBLICATIONS

Steam Generator Update-Jul. 1976-Westinghouse Electric Corp., pp. 10153-10155 to 10153-10159.

*Primary Examiner*—L. J. Paperner
*Attorney, Agent, or Firm*—L. A. DePaul; Z. L. Dermer

[57] ABSTRACT

A multi-function end effector for performing operations on equipment located in areas where human access is limited comprises a vertical support capable of being supported in the equipment on which the operations are to be performed, such as a nuclear steam generator, along with a table attached to the vertical support. The table is capable of positioning tools in relation to the equipment and is capable of driving the tools. The table comprises a centering device for positioning the tools in proper relation to the equipment.

14 Claims, 22 Drawing Figures

MULTI-FUNCTION END EFFECTOR

CROSS-REFERENCE TO RELATED APPLICATIONS

The invention described herein is related to copending applications Ser. No. 806,233, now U.S. Pat. No. 4,148,403, filed June 13, 1977, entitled "Remote Access Manipulator" by D. R. Riffe, and Ser. No. 806,232, filed June 13, 1977, entitled "Remote Access Manipulator" by R. H. Sturgess, Jr., both of which are assigned to the assignee of the present application.

BACKGROUND OF THE INVENTION

This invention relates to remote access manipulators and more particularly to remote access manipulators for inspecting and repairing nuclear steam generators.

There are many situations in which a hazardous environment limits human access to various locations. One such situation occurs in the inspection and repair of nuclear steam generators. A typical nuclear steam generator comprises a vertically oriented shell, a plurality of U-shaped tubes disposed in the shell so as to form a tube sheet for supporting the tubes at the ends opposite the U-like curvature, and a dividing plate that cooperates with the tube sheet forming a primary fluid inlet plenum at one end of the tube bundle and a primary fluid outlet plenum at the other end of the tube bundle. The primary fluid having been heated by circulation through the nuclear reactor core enters the steam generator through the primary fluid inlet plenum. From the primary fluid inlet plenum, the primary fluid flows upwardly through first openings in the U-tubes near the tube sheet which supports the tubes, through the U-tube curvature, downwardly through second openings in the U-tubes near the tube sheet, and into the primary fluid outlet plenum. At the same time, a secondary fluid, known as feedwater, is circulated around the U-tubes in heat transfer relationship therewith thereby transferring heat from the primary fluid in the tubes to the secondary fluid surrounding the tubes causing a portion of the secondary fluid to be converted to steam. Since the primary fluid contains radioactive particles and is isolated from the secondary fluid by the U-tube walls and tube sheet, it is important that the U-tubes and tube sheet be maintained defect-free so that no breaks will occur in the U-tubes or in the welds between the U-tubes and the tube sheet thus preventing contamination of the secondary fluid by the primary fluid.

Occasionally it is necessary to either inspect or repair the U-tubes or tube sheet welds by way of access through the primary fluid inlet and outlet plena. For this purpose manways are provided in the vertical shell so that working personnel may enter the inlet and outlet plena to perform operations on the U-tubes and tube sheet. However, since the primary fluid which is generally water contains radioactive particles, the inlet and outlet plena become radioactive which thereby limits the time that working personnel may be present therein. Accordingly, it would be advantageous to be able to perform operations of the U-tubes and tube sheet without requiring the presence of working personnel. There are several mechanisms known in the art that attempt to provide a solution to this problem, but none of them have been able to completely solve the problem.

In U.S. Pat. No. 3,913,752 to C. T. Ward et al., issued Oct. 21, 1975 and entitled "Remote Movable Platform" there is described a remotely movable carriage which serves as a mobile platform from which remotely initiated and controlled inspection and work operations might be performed on the tubes in a nuclear steam generator. The carriage includes a stepping mechanism which interacts with a member, such as a tube sheet, relative to which the carriage moves in generally parallel relationship. The stepping mechanism may employ selectively extensible fingers for lateral engagement with the openings in the members. In addition, an extension device may be employed for remotely handling the carriage through the manway during installation and removal. In monitoring the location of the carriage various techniques may be used such as television or, preferably, techniques which initially establish the location of the carriage relative to the tube sheet when first placed against the under surface of the tube sheet and which then plot and monitor the movement of the carriage across the tube sheet surface. While the patent to Ward et al. does describe one type of remote access device, it does not completely solve the problem of remote access operation on members such as tube sheets. For example, should there be a power loss during operation the plotting and monitoring mechanism may not be capable of reestablishing the location of the carriage. Furthermore, should a substantial number of tubes in one area be plugged by deposits, the Ward device might not be able to traverse the plugged area.

Another device for inspecting a tube sheet is described in U.S. Pat.No. 4,004,698 to B. Gebelin issued Jan. 25, 1977 and entitled "Device For Positioning A Member On A Tubular Plate." The device comprises two perpendicular arms capable of relative motion for transporting the member along the tube sheet. While the two perpendicular arms are capable of movement along a rectangular coordinate array of tubes, difficulty would be encountered in avoiding large areas of plugged tubes.

SUMMARY OF THE INVENTION

A multi-function end effector for performing operations on equipment located in areas where human access is limited comprises a vertical support capable of being supported in the equipment on which the operations are to be performed, such as a nuclear steam generator, along with a table attached to the vertical support. The table is capable of positioning tools in relation to the equipment and is capable of driving the tools. The table comprises a centering device for positioning the tools in proper relation to the equipment including a pilot device for positioning the tools in colinear alignment with tubular members of the equipment. The end effector also comprises transfer mechanisms capable of being used in conjunction with remote manipulators.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings, wherein:

DESCRIPTION OF THE PREFERRED EMBODIMENT

In a tube-type steam generator, a tube sheet supports a bundle of heat transfer tubes. The invention described herein provides a multi-function end effector for performing operations on equipment location in areas where human access is limited such as a tube sheet of a steam generator.

Figure 1:
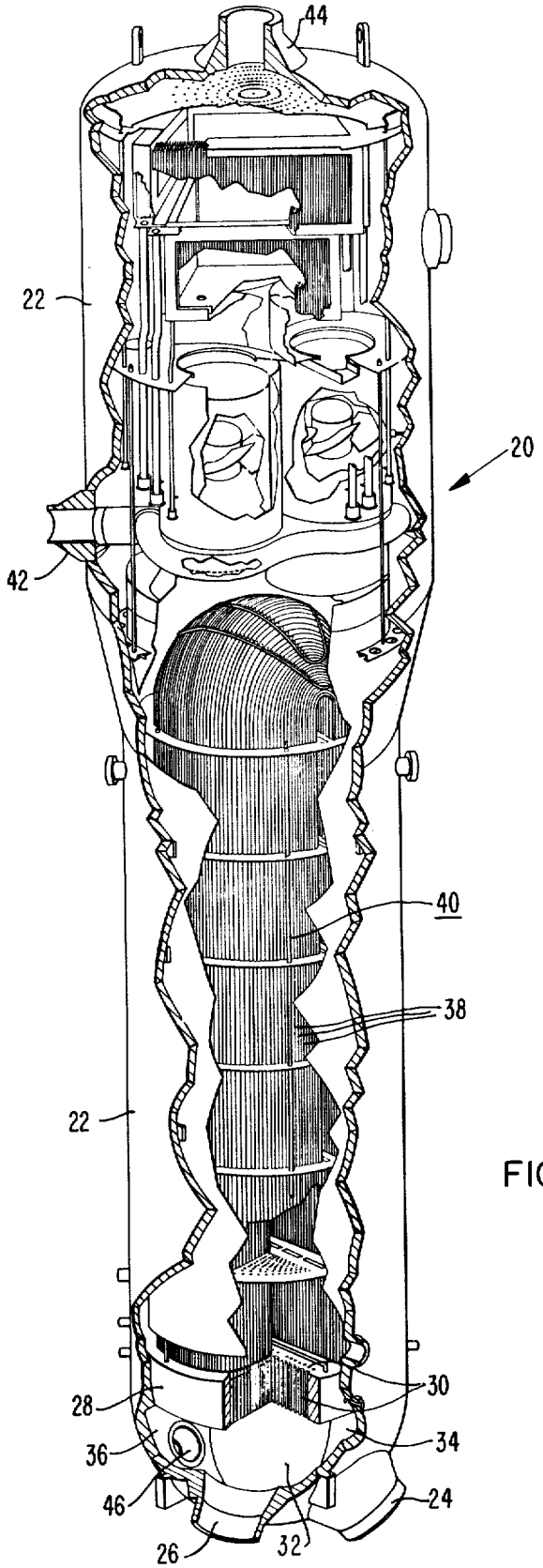
FIG. 1 is a partial cross-sectional view in elevation of a typical steam generator.

Referring to FIG. 1, a nuclear steam generator referred to generally as 20, comprises an outer shell 22 with a primary fluid inlet nozzle 24 and a primary fluid outlet nozzle 26 attached thereto near its lower end. A generally cylindrical tube sheet 28 having tube holes 30 therein is also attached to outer shell 22 near its lower end. A dividing plate 32 attached to both tube sheet 28 and outer shell 22 defines a primary fluid inlet plenum 34 and a primary fluid outlet plenum 36 in the lower end of the steam generator as is well understood in the art. Tubes 38 which are heat transfer tubes shaped with a U-like curvature are disposed within outer shell 22 and attached to the tube sheet 28 by means of tube holes 30. Tubes 38 which may number about 7,000 form a tube bundle 40. In addition, a secondary fluid inlet nozzle 42 is disposed on outer shell 22 for providing a secondary fluid such as water while a steam outlet nozzle 44 is attached to the top of outer shell 22. In operation, the primary fluid which may be water having been heated by circulation through the nuclear reactor core enters steam generator 20 through primary fluid inlet nozzle 24 and flows into primary fluid inlet plenum 34. From primary fluid inlet plenum 34 the primary fluid flows upwardly through the tubes 38 in tube sheet 28, up through the U-shaped curvature of tubes 38, down through tubes 38 and into primary fluid outlet plenum 36 where the primary fluid exits the steam generator through primary fluid outlet nozzle 26. While flowing through tubes 38, heat is transferred from the primary fluid to the secondary fluid which surrounds tubes 38 causing the secondary fluid to vaporize. The resulting steam then exits the steam generator through steam outlet nozzle 44. On occasion, it is necessary to inspect or repair tubes 38 or the welds between tubes 38 and tube sheet 28 to assure that the primary fluid which may contain radioactive particles remains isolated from the secondary fluid. Therefore, manways 46 are provided in outer shell 22 to provide access to both primary fluid inlet plenum 34 and primary fluid outlet plenum 36 so that access may be had to the entire tube sheet 28.

Figure 2:
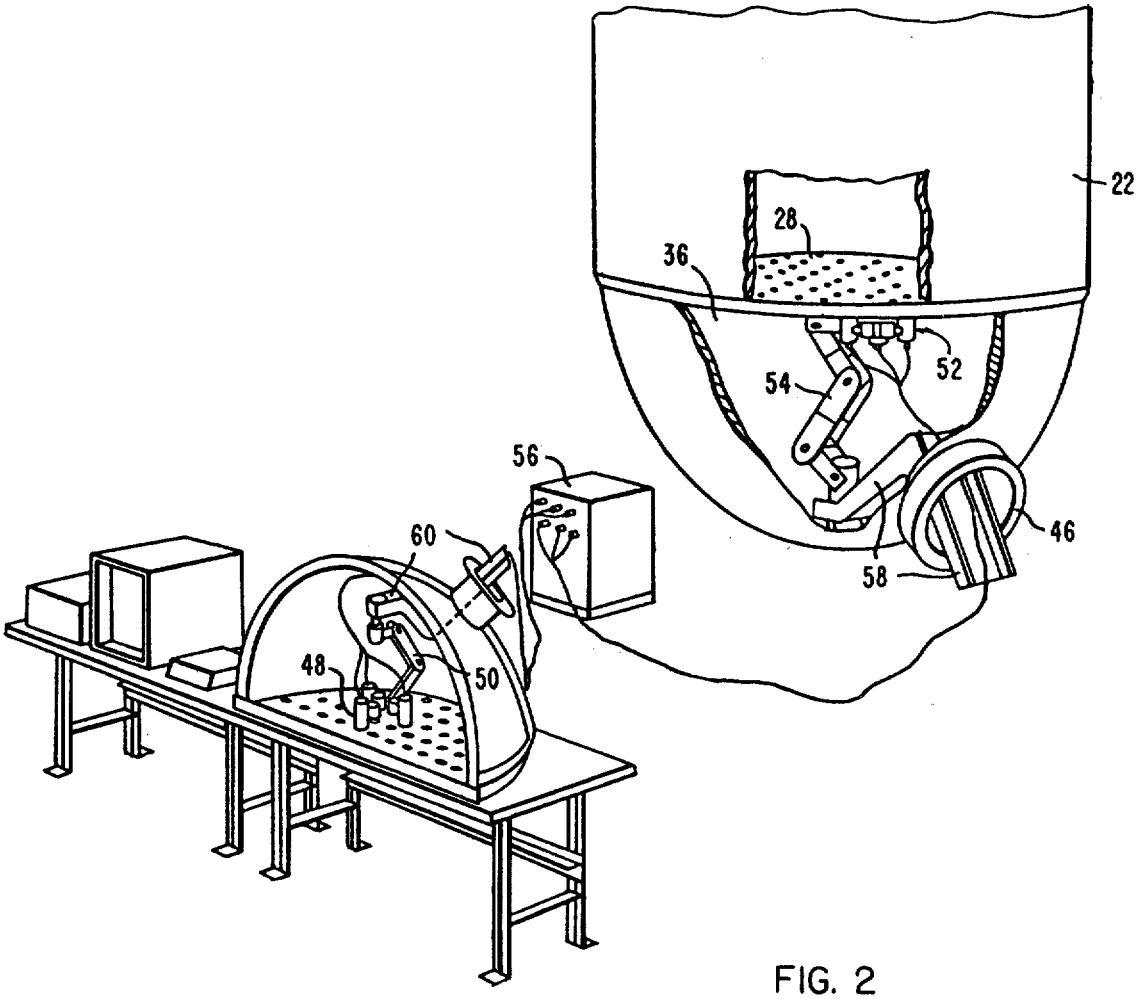
FIG. 2 is a diagram showing the slave carriage and slave manipulator arm in a plenum of a steam generator along with the master carriage and master manipulator arm in an inverted scale model of a steam generator.

Referring now to FIG. 2, the remote access manipulator comprises a master carriage 48, master manipulator arm 50, slave carriage 52, and slave manipulator arm 54. Master carriage 48 and master manipulator arm 50 are located in a scale model of the equipment on which operations are to be performed such as a scale model of a steam generator while slave carriage 52 and slave manipulator arm 54 are located in the actual steam generator 20. Master carriage 48 and master manipulator arm 50 are connected by cables to control box 56 which is also connected to slave carriage 52 and slave manipulator arm 54. Slave manipulator arm 54 is movably mounted on slave track 58 which extends through manway 46 and into approximately the center of primary outlet plenum 36 such that slave manipulator arm 54 may be advanced into and out of steam generator 20 along slave track 58. Likewise, master manipulator arm 50 is movably mounted on master track 60 which extends through the scale model of the manway and into the scale model of the steam generator. The controls of the remote access manipulator are such that the scale model of the steam generator along with master carriage 48 and master manipulator arm 50 are located remote from the actual steam generator thereby eliminating the radiological problems associated with personnel access. Working personnel may then manually move master carriage 48 and master manipulator arm 50 to a desired location while slave carriage 52 and slave manipulator arm 54 perform the same movement in the actual steam generator. In this manner, operations may be performed on the actual steam generator with greatly reduced personnel radiation exposure.

Figure 3:
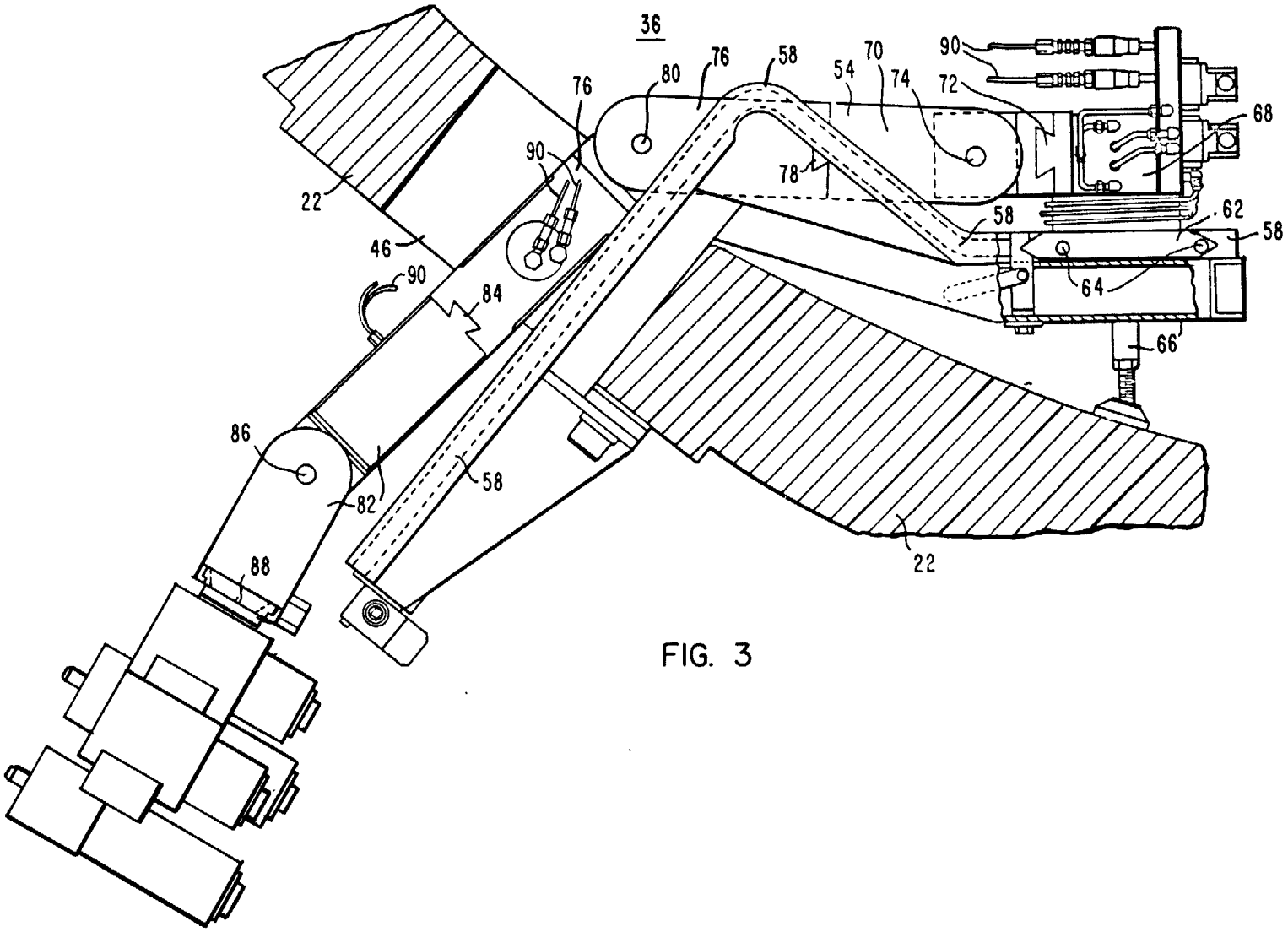
FIG. 3 is a partial cross-sectional view in elevation of a manipulator arm and carriage extending through a manway of a steam generator.
Figure 4:
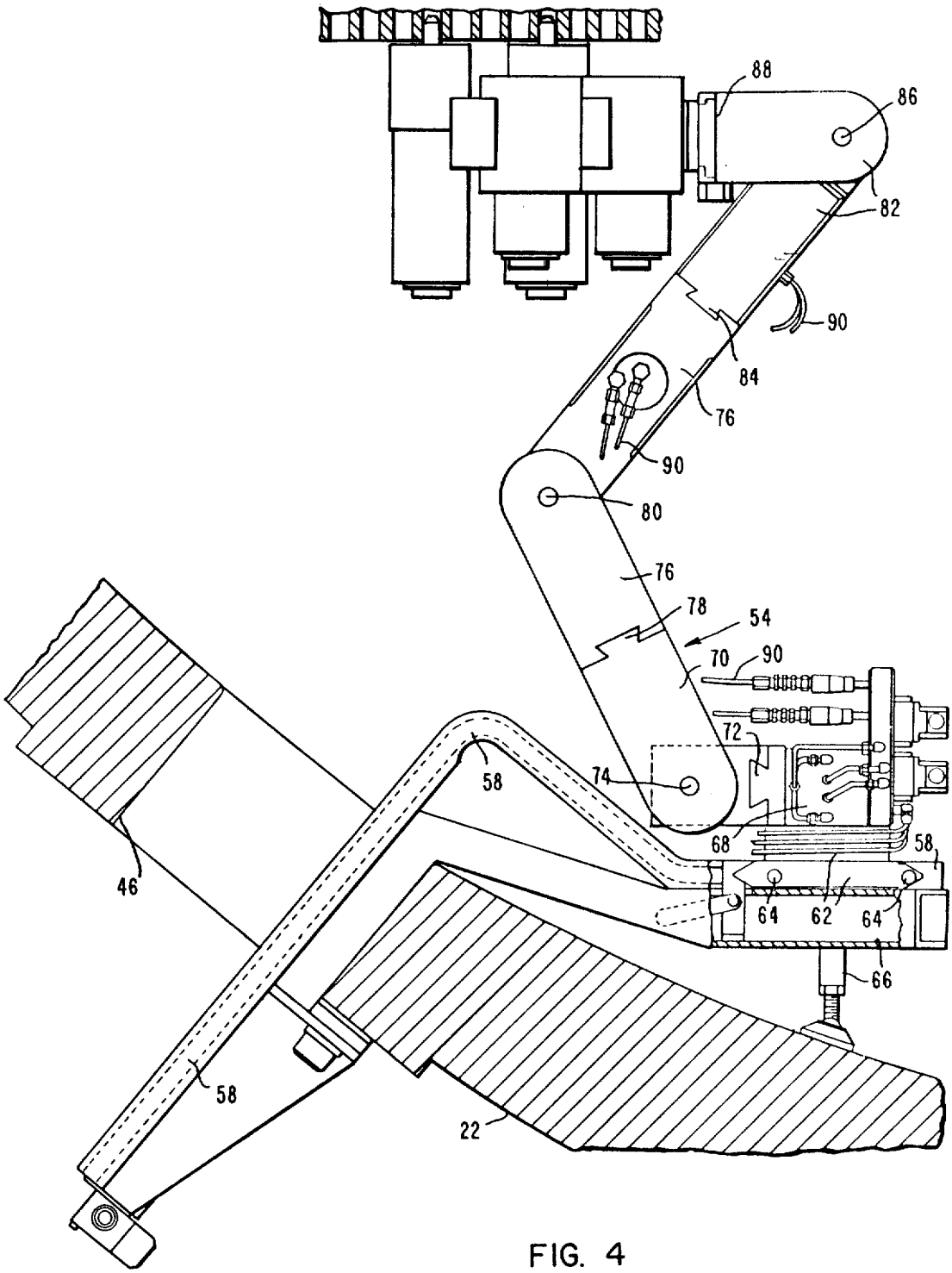
FIG. 4 is a partial cross-sectional view in elevation of the slave manipulator arm and slave carriage in a plenum of a steam generator.
Figure 5:
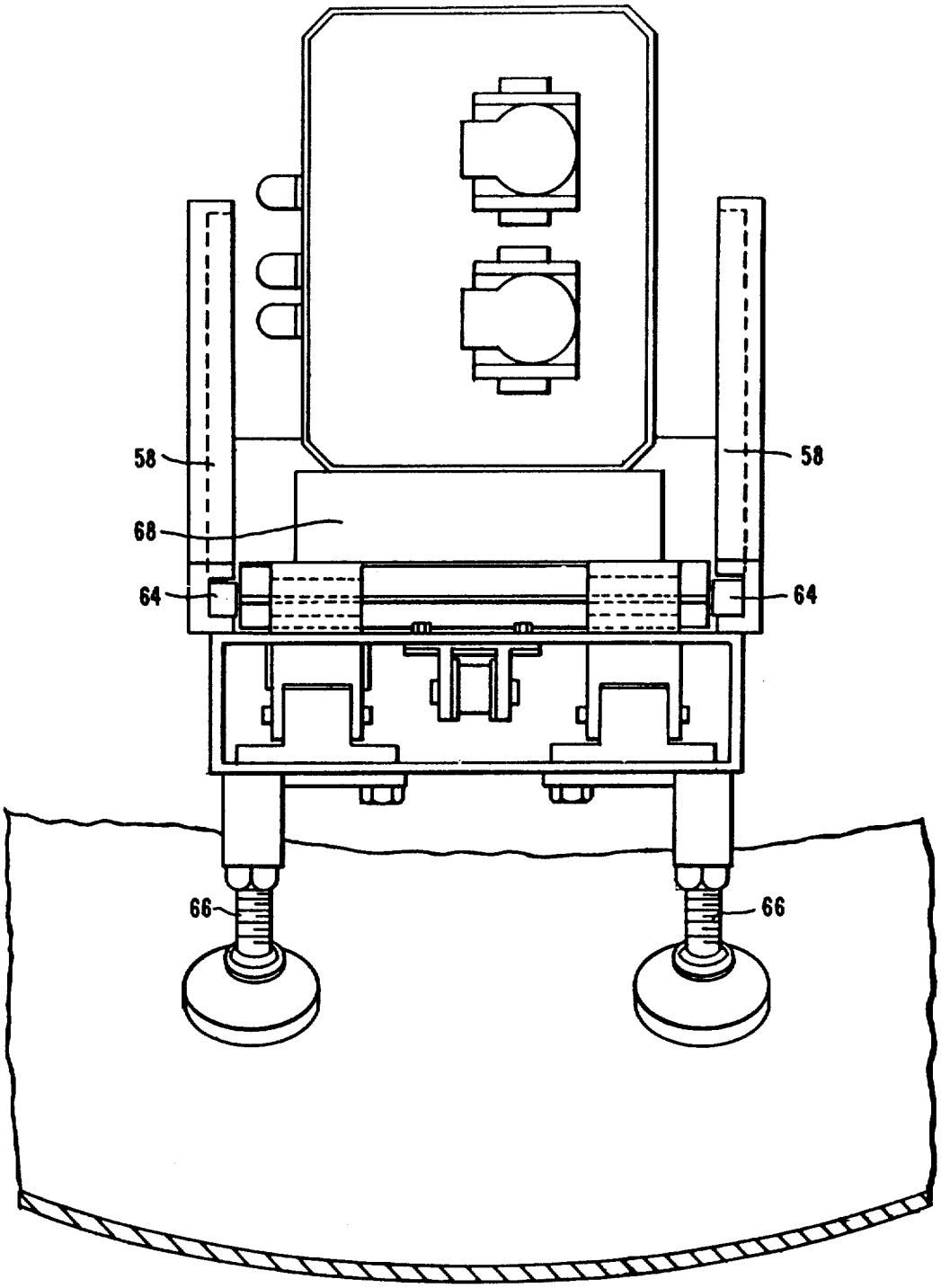
FIG. 5 is an end view of a manipulator arm and track.

Referring to FIGS. 3-5, slave manipulator arm 54 is shown extended through manway 46 with slave carriage 52 attached to the end thereof. It should be noted that while only slave carriage 52 and slave manipulator arm 54 are show in FIG. 3, FIG. 3 also represents master carriage 48 and master manipulator arm 50 since they are substantially similar. Slave manipulator arm 54 comprises a base 62 having cam rollers 64 attached thereto. Cam rollers 64 are disposed in track 58 along with a chain (not shown) so that base 62 may be advanced along track 58 by advancing the chain in the desired direction. Track 58 is supported from the bottom of the steam generator by stand 66.

First segment 68 is rotatably mounted on base 62 such that first segment 68 may rotate about a vertical axis through base 62. Base 62 contains a potentiometer chosen from those well known in the art that senses the angle of rotation between first segment 68 and base 62. First segment 68 is connected to second segment 70 by a first dovetail joint 72 so that the segment may be easily assembled or disassembled. Second segment 70 has a first rotatable joint 74 which allows a portion of second segment 70 to rotate about a horizontal axis through first rotatable joint 74. Similarly, third segment 76 is attached to second segment 70 by second dovetail joint 78 and has a second rotatable joint 80 similar to first rotatable joint 74. Likewise, fourth segment 82 is attached to third segment 76 by third dovetail joint 84 and has a third rotatable joint 86 similar to first rotatable joint 74. Fourth segment 82 also has a remotely actuated gripper mechanism 88 which allows the manipulator arm to be attached to the carriage or tools. First rotatable joint 74, second rotatable joint 80, third rotatable joint 86 and the rotatable joint between base 62 and first segment 68 of the slave manipulator arm 54 may be powered by hydraulic vane-type rotary actuators with integral potentiometers to sense the angle of rotation. Hydraulic rotary actuators may be chosen because of their lightweight characteristic which increases the maneuverability of the slave manipulator arm 54. Of course, flexible conduits 90 are provided to conduct the hydraulic fluid from a fluid source to the rotary vane actuators under control from control box 56. Since the master manipulator arm 50 is powered manually there is no need for rotary actuators in the master manipulator joints. However, potentiometers similar to those in the slave manipulator arm 54 are present in the master manipulator arm 50. Manual movement of the master manipulator arm 50 by the working personnel is sensed by the potentiometers therein and relayed to a servo control module located in control box 56 which may be chosen from those well known in the art such as a servo control module from Moog Incorporated which sends a command signal to the slave manipulator arm 54 rotary actuators that causes the rotary actuators to move in a direction to eliminate the difference in reading between the potentiometers of the master and slave manipulator arms. Such signals thereby cause the slave manipulator arm to replicate the movement of the master manipulator arm. Accordingly, by properly moving the master manipulator arm with master carriage attached, the slave manipulator arm with attached slave carriage can be made to move the slave carriage 52 from outside the steam generator to attachment with tube sheet 28 of the steam generator as shown in FIGS. 3 and 4. It should be noted that for ease of operator control, the master carriage, master manipulator arm, scale model, and corresponding controls may be arranged inversely to the slave arrangement thereby allowing the operator to more easily view the master scale model. In addition, closed circuit television may be provided as an auxiliary check on the location of the slave apparatus and to provide assistance during docking operations.

Figure 6:
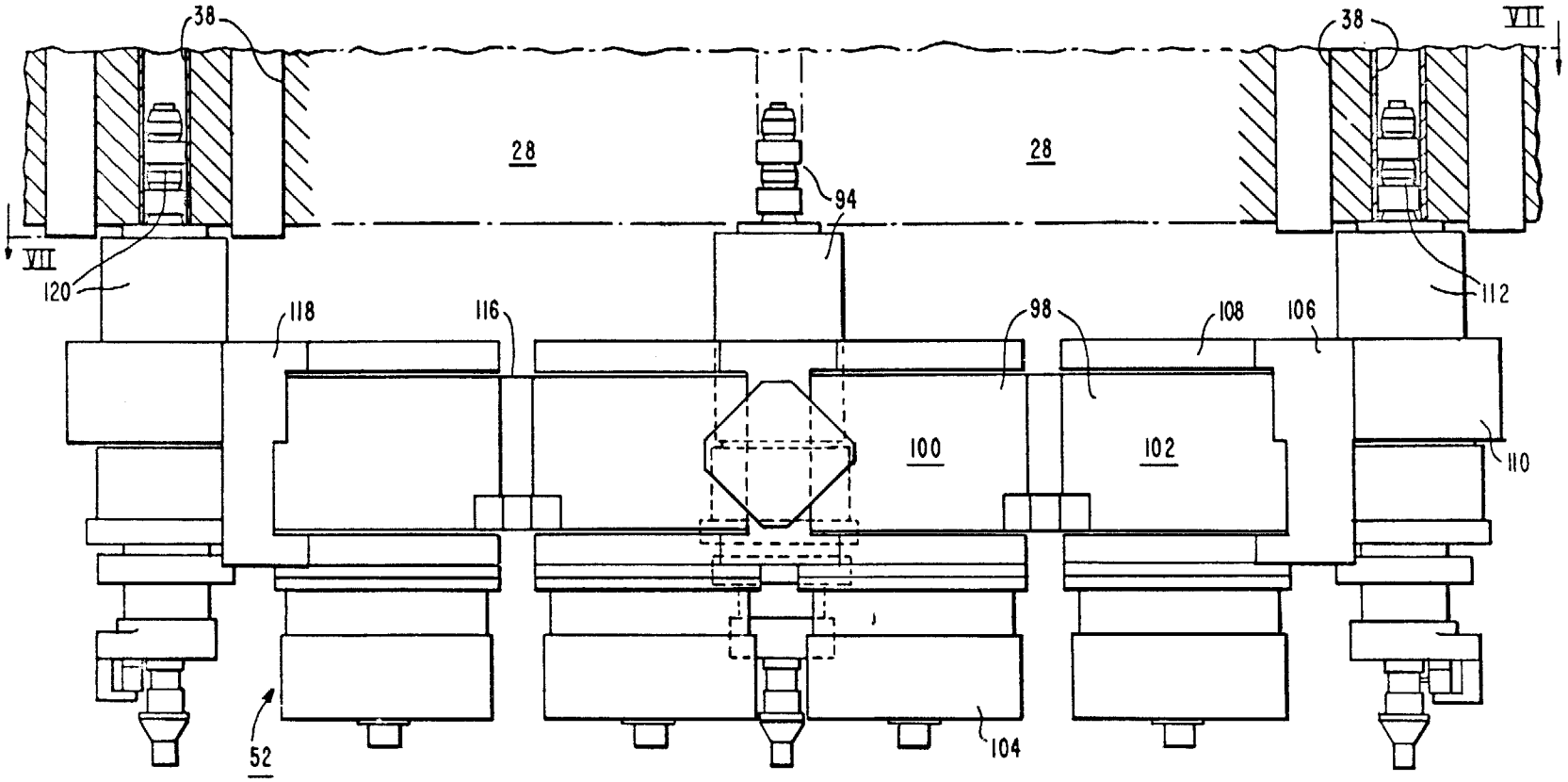
FIG. 6 is a partial cross-sectional view in elevation of a tube sheet and slave carriage.
Figure 7:
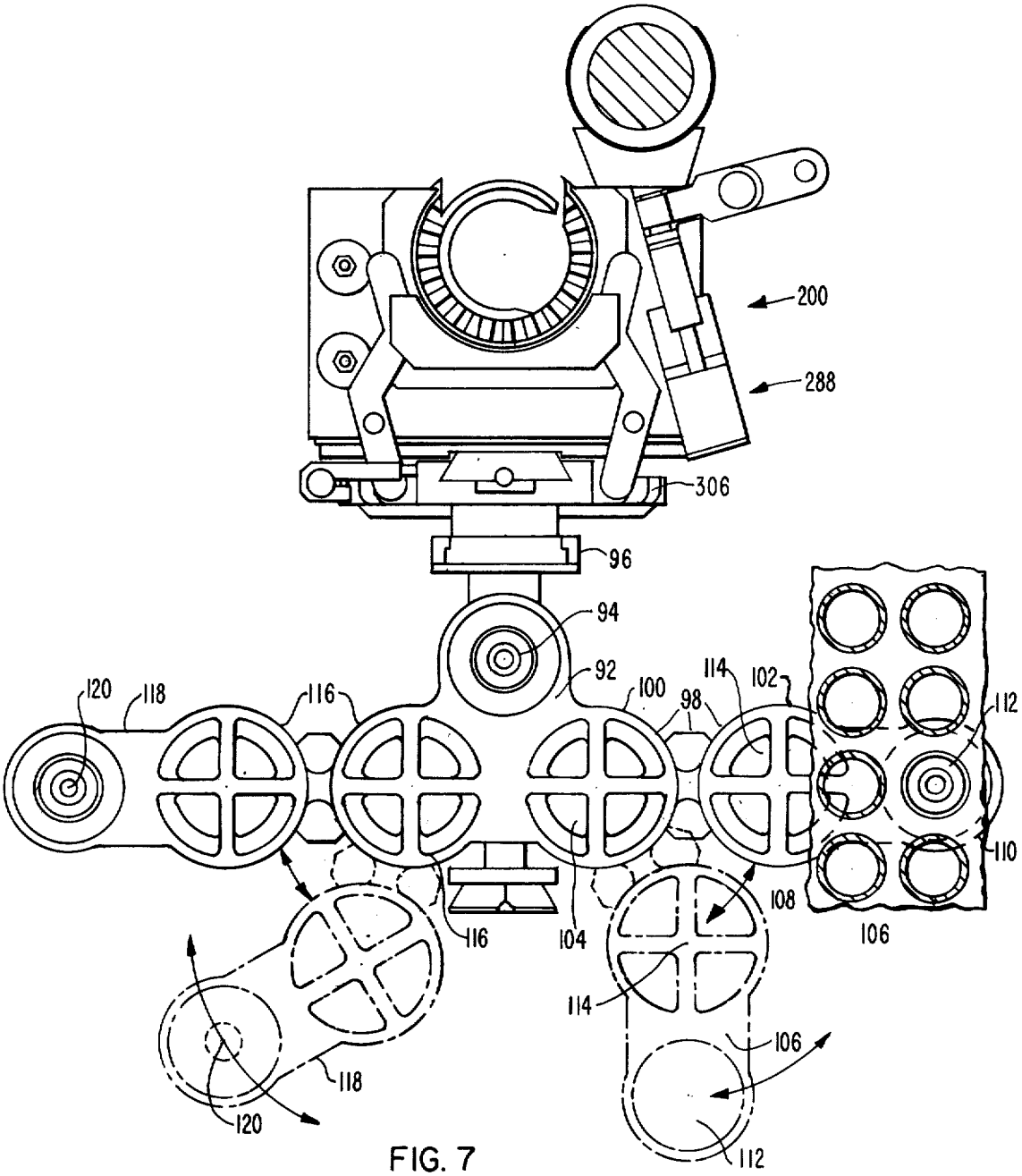
FIG. 7 is a plan view of a slave carriage, multi-function end effector, and tube sheet.

FIGS. 6 and 7 illustrate slave carriage 52 in its engagement with a tube sheet 28. While master carriage 48 is not shown in FIGS. 6 and 7, it is to be understood that master carriage 48 is similar to slave carriage 52 which is shown in FIGS. 6 and 7. The main difference between slave carriage 52 and master carriage 48 lies in the fact that master carriage 48 is manually movable while slave carriage 52 mechanically replicates the manual movements of master carriage 48. As can be seen in FIGS. 6 and 7, slave carriage 52 comprises a body 92 which serves as the central portion of the carriage. Body 92 has a first cam lock 94 which is capable of engaging the interior of a tube 38 of tube sheet 28 for suspending slave carriage 52 beneath tube sheet 28. Body 92 also has an end effector attachment 96 on the end thereof for holding tools for inspecting or repairing tube sheet 28 or tubes 38. End effector attachment 96 may be a remotely actuated gripper mechanism such as gripper mechanism 88 or other gripper device that is capable of firmly engaging a work tool. When an end effector such as a work tool has been attached to end effector attachment 96 by slave manipulator arm 54, slave carriage 52 is capable of traversing tube sheet 28 for positioning the end effector at an appropriate location under the control of master carriage 48 and master manipulator arm 50.

Still referring to FIGS. 6 and 7, body 92 has a first housing 98 rotatably attached thereto. First housing 98 has a first end 100 which is rotatably disposed within body 92 and a second end 102 that extends outwardly from body 92. A first motor 104 is located within first end 100 and provides first housing 98 with the capability of rotating with respect to body 92. First end 100 also has angle sensing potentiometer disposed therein for determining the angle of rotation of first housing 98 with respect to body 92. Master carriage 48 similarly has an angle sensing potentiometer that senses its angle. Of course, master carriage 48 does not have motors therein because it is manually operated. Manual movement of master carriage 48 is sensed by its potentiometers and relayed to control box 56. A servo control module such as one from Moog Incorporated and located in control box 56 determines if there is a difference between the reading of the potentiometers in the slave carriage and master carriage and commands the slave carriage motors to rotate until there is no difference in potentiometer readings. Thus, manual movement of master carriage 48 is translated into mechanical movement of slave carriage 52.

A second housing 106 has a first portion 108 similarly rotatably disposed around second end 102 of first housing 98 and a second portion 110 extending outwardly from first portion 108. Second portion 110 has a second cam lock 112 attached thereto which is similar to first cam lock 94. Second housing 106 also has a second motor 114 disposed within first portion 108 that provides second housing 106 with the capability of rotating with respect to first housing 98. Another angle sensing potentiometer is located in second housing 106 for detecting its angle of rotation in a manner similar to the potentiometer of first housing 98. Likewise, a third housing 116 and a fourth housing 118 are connected to body 92 on a side opposite first housing 98 and second housing 106. Third housing 116 may be identical to first housing 98 while fourth housing 118 may be identical to second housing 106 with fourth housing 118 having a third cam lock 120 disposed therein.

As is illustrated in FIG. 7, both master carriage 48 and slave carriage 52 are capable of placing the cam locks in numerous locations which allows the slave carriage 52 to be able to traverse tube sheet 28 in an unlimited number of directions. The carriages are also capable of traversing a tube sheet 28 with an irregular tube hole configuration or an uneven tube sheet surface. As described previously, movement of the housings is accomplished by manual manipulation of master carriage 48 is translated into mechanical movement of slave carriage 52. Similarly, insertion and withdrawal of the cam locks of master carriage 48 is manually accomplished and translated by electronic relays and sensing devices into mechanical movement of the slave carriage cam locks. The operation of slave carriage 52 is such that only one cam lock is withdrawn while the other two cam locks remain engaged in tube sheet 28. With the one cam lock withdrawn, the manipulation of the master carriage can position the withdrawn cam lock in a new position. When in the new position the cam lock can be inserted in a tube 38 and another cam lock withdrawn and repositioned. In this manner, the slave carriage can be made to traverse the entire tube sheet 28. Moreover, with all three cam locks locked into tube sheet 28 body 92 is capable of rotating about first cam lock 94 so as to position end effector attachment 96 wih a tool attached thereto in a number of different locations. Such movements of slave carriage 52 serve to position an end effector such as a work tool in appropriate locations to perform operations on the sheet 28.

Referring now to FIGS. 8–13, one of the cam locks of slave carriage 52 is shown in the withdrawn position. The cam lock comprises an outer housing 122 with bearings 124 which mounts inner housing 126 within outer housing 122 in a rotatable manner. Of course, outer housing 122 corresponds to any of body 92, second housing 106, or fourth housing 118 wherein there is disposed a cam lock. Bearings 124 enable outer housing 122 to rotate about the cam lock even though the cam lock has been inserted in a tube 38. A central member 128 is disposed within inner housing 126 but is not fixedly attached thereto. A cup member 130 is attached to the top portion of central member 128 so as to form a step 132 that allows cup member 130 to rest on inner housing 126 at step 132. Since central member 128 is attached to cup member 130, the weight of central member 128 is also transmitted to inner housing 126 by means of step 132. It should be noted that cup member 130 is not attached to inner housing 126 at step 132 but merely rests thereon at step 132 and is capable of relative motion at that interface. Cup member 130 acts to contact tubes 38 so as to determine the location of the carriage with respect to the tube sheet 28.

Figure 8:
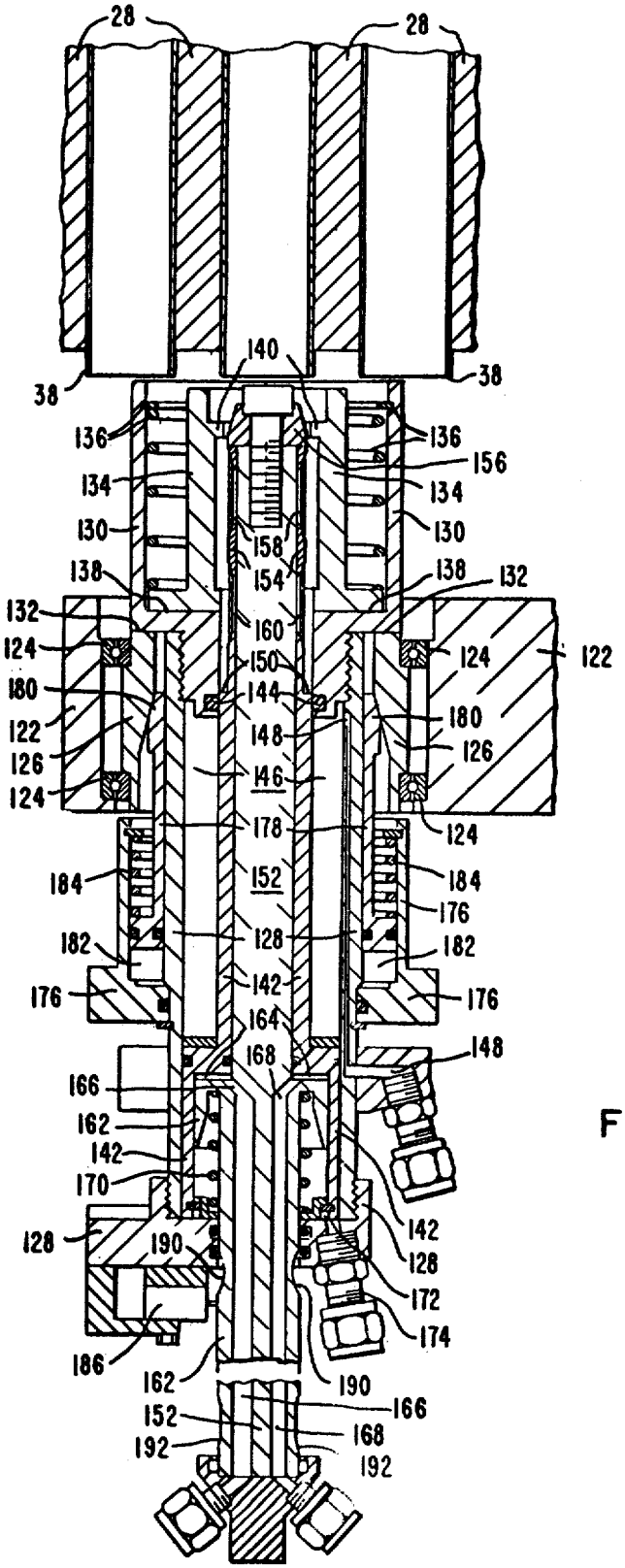
FIG. 8 is a cross-sectional view in elevation of a cam lock in the withdrawn position.
Figure 9:
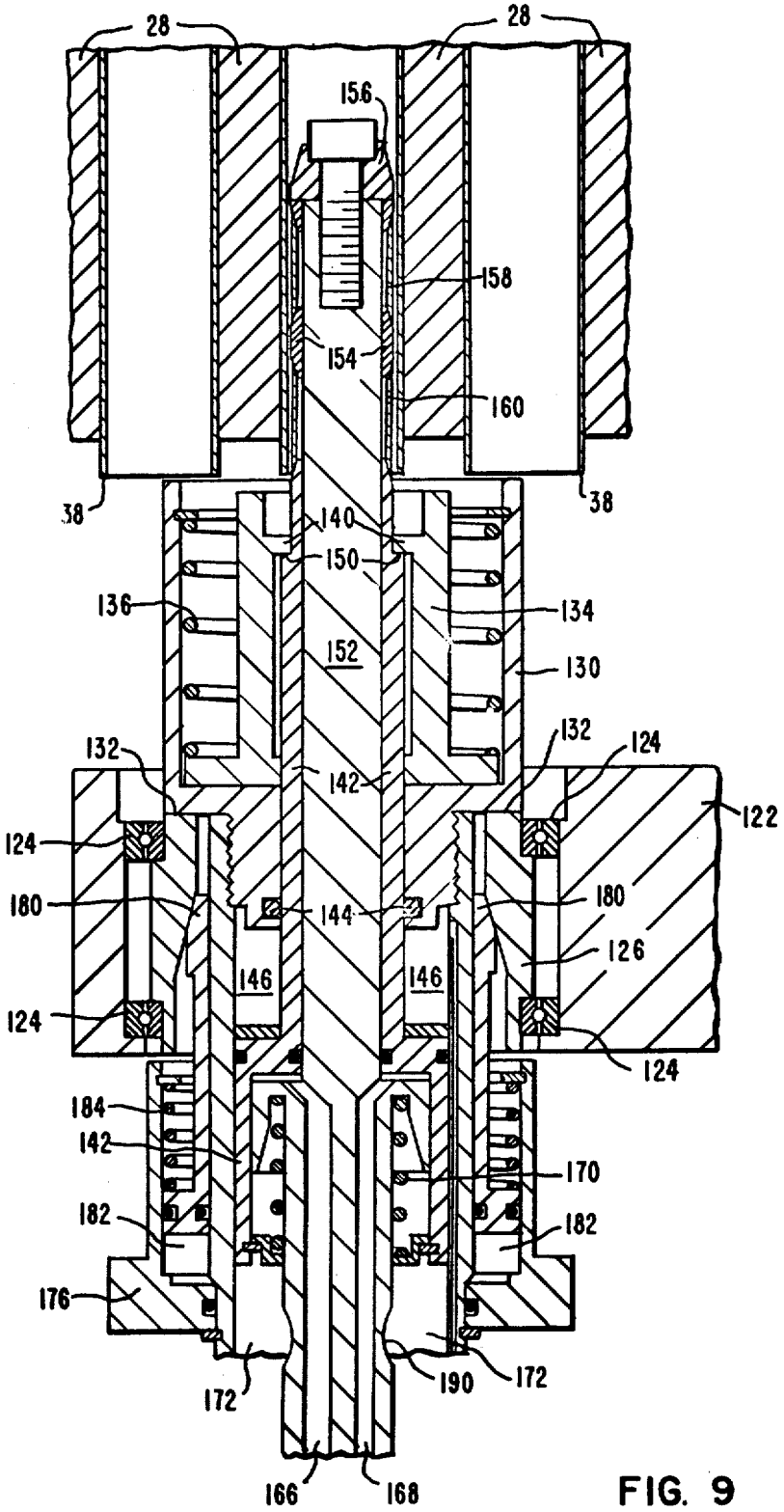
FIG. 9 is a cross-sectional view in elevation of a cam lock in the inserted unlocked position.
Figure 10:
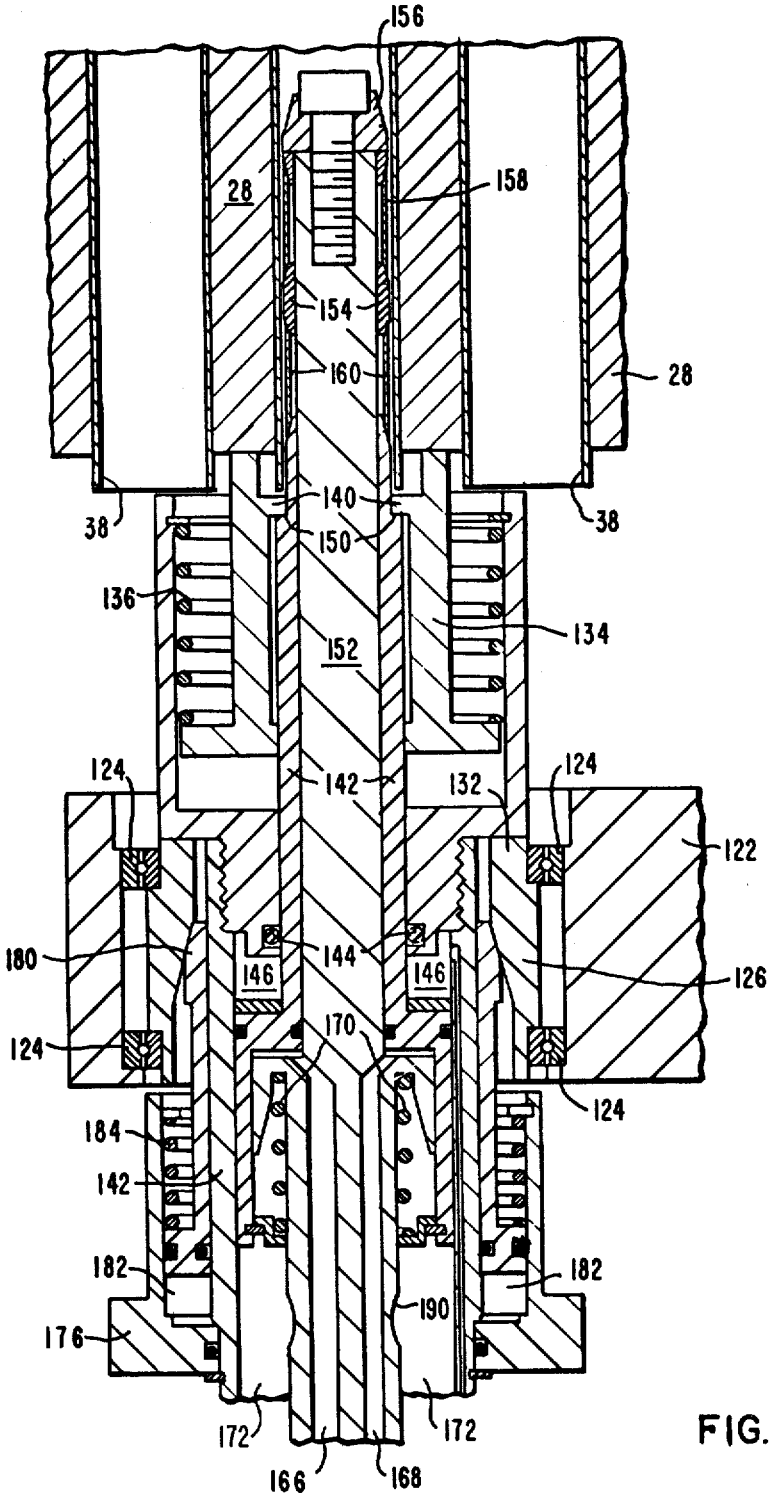
FIG. 10 is a cross-sectional view in elevation of a cam lock in the inserted unlocked abutting position.
Figure 11:
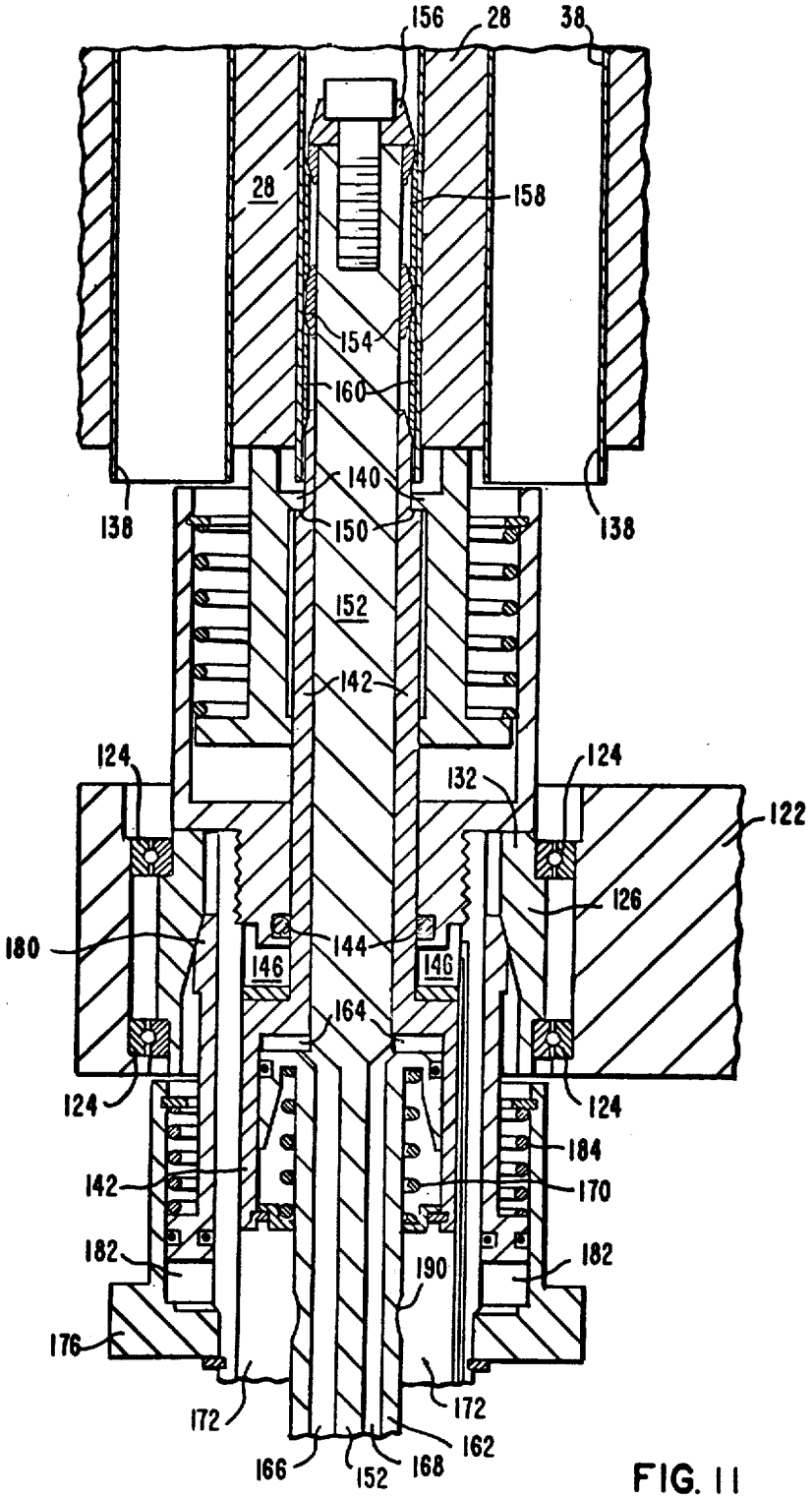
FIG. 11 is a cross-sectional view in elevation of a cam lock in the inserted locked position.
Figure 12:
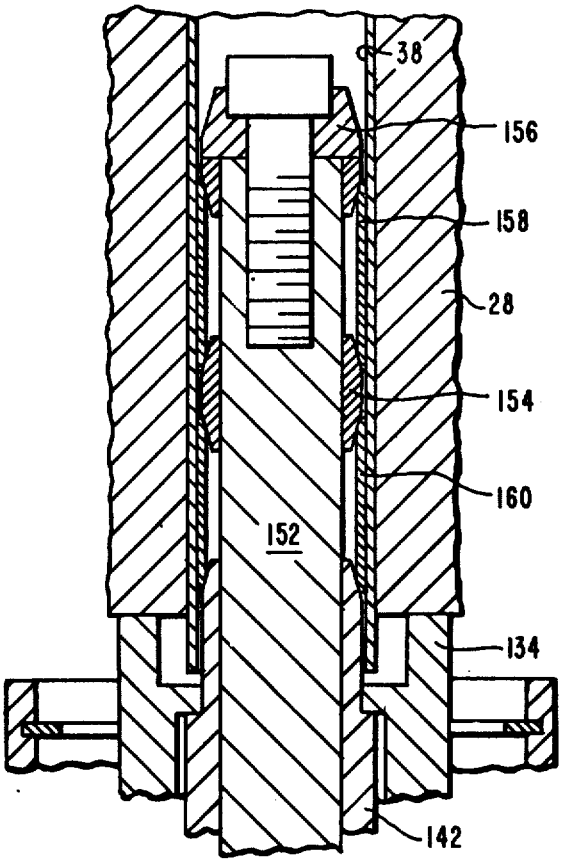
FIG. 12 is an enlarged cross-sectional view in elevation of a cam lock in the inserted locked position.

Still referring to FIGS. 8–13, a first slider member 134 is disposed within cup member 130 and is capable of relative motion with respect to cup member 130. A first biasing mechanism 136 which may be a coil spring with a stop is arranged between cup member 130 and first slider member 134 so as to urge first slider member 134 against cup member 130 along first interface 138. In addition, first slider member 134 has a first ledge 140 for engaging members disposed therein. A second slider member 142 is slidably disposed partially within cup member 130 and within central member 128. A sliding seal 144 which may be an O-ring is located between cup member 130 and second slider member 142 for sealing the members together while allowing relative motion therebetween. Second slider member 142, cup member 130, and central member 128 define a first annular chamber 146 for accommodating a fluid such as air for forcing second slider member 142 downwardly with respect to cup member 130. A first channel 148 is provided in fluid communication with first annual chamber 146 for introducing a fluid thereinto. Second slider member 142 also has a second ledge 150 for engaging first ledge 140 of first slider member 134 that causes first slider member 134 to contact tube sheet 28 as shown in FIG. 10. A third slider member 152 is disposed within second slider member 142 and is capable of sliding relative thereto. A spacer 154 is attached to the top portion of third slider member 152 and a cap 156 is attached to the top end of third slider member 152. A first metal ring 158 is disposed around third slider member 152 and between cap 156 and spacer 154 while a second metal ring 160 is located around third slider member 152 and between spacer 154 and second slider member 142. First metal ring 158 and second metal ring 160 generally fit loosely around third slider member 152 and may have a slot therein or they may have a plurality of slots that extend substantially the length of the ring for accommodating radial expansion. However, when third slider member 152 is drawn downwardly relative to second slider member 142, the beveled edges of cap 156, spacer 154, and second slider member 142 cause both first metal ring 158 and second metal ring 160 to expand. At this point, third slider member 152 will be disposed within a tube 38 so that the expansion of the metal rings 158 and 160 will cause the rings to contact the interior of a tube 38 thus locking the cam lock in place as shown in FIGS. 10–12.

Again referring to FIGS. 8–13, a fourth slider member 162 which may be an integral portion of third slider member 142 (as shown in the drawings) or a separate member attached to third slider member 152 is slidably disposed within second slider member 142 and central member 128. Fourth slider member 162, second slider member 142, and third slider member 152 define a second annular chamber 164 for accommodating a fluid such as oil for forcing third slider member 152 downwardly with respect to second slider member 142 which initiates the expansion of rings 158 and 160. A second channel 166 is provided in fourth slider member 162 for introducing the fluid into second annular chamber 164 while a third channel 168 is provided for removing the fluid therefrom. Of course, both second channel 166 and third channel 168 may be used simultaneously to introduce the fluid into second annular chamber 164. Generally, second channel 166 is larger in diameter than third channel 168 so that gases that may be present in second annular chamber 164 may be bled off through third channel 168 while the oil is introduced through second channel 166. In addition, a second biasing mechanism 170 which may be a coil spring is arranged between second slider member 142 and fourth slider member 162 for urging fourth slider member 162 against second slider member 142 thereby tending to close second annular chamber 164. Furthermore, a third annular chamber 172 is defined between the bottom of second slider member 142 and central member 128 for accommodating a fluid such as air for forcing second slider member 142 upwardly toward tube sheet 28 which also causes third slider member 152 and fourth slider member 162 to be moved upwardly. The fluid may be introduced into third annular chamber 172 through a fourth channel 174 which may also serve to remove the fluid therefrom. It is to be observed that it is the action of introducing a fluid such as air into third annular chamber 172 that causes third slider member 152 to be inserted into a tube 38 of tube sheet 28. Likewise, it is this action which causes second slider member 142 to force first slider member 134 against tube sheet 28. When third slider member 152 has thus been inserted into a tube 38, introduction of a fluid into second annular chamber 164 causes third slider member 152 to move slightly downward relative to second slider 142 thus expanding rings 158 and 160 which causes the mechanism to be tightly locked into tube 38.

Still referring to FIG. 8, an outer member 176 is attached around central member 128 and has a fifth slider member 178 slidably disposed therein. Fifth slider member 178 has a beveled head 180 formed on the top end thereof that conforms to the curvature of inner housing 126. A fourth annular chamber 182 is defined by outer member 176, fifth slider member 178 and central member 128 for accommodating a fluid such as oil. Channel and valves (not shown) are also provided for conducting the fluid to fourth annular chamber 182. When the fluid has been introduced into fourth annular chamber 182, fifth slider member 178 is forced upwardly against inner housing 126. This procedure is normally performed when third slider member 152 has been locked in a tube 30 in which case the contact of fifth slider member 178 against inner housing 126 will cause inner housing 126 to become aligned with third slider member 152 thus aligning the cam lock with the particular tube 38. A third biasing mechanism 184 which may be a coil spring is arranged between outer member 176 and fifth slider member 178 so as to urge fifth slider member 178 downwardly. When the fluid pressure is released from fourth annular chamber 182, third biasing mechanism 184 causes fifth slider member 17 to move downwardly with respect to outer member 176.

Figure 13:
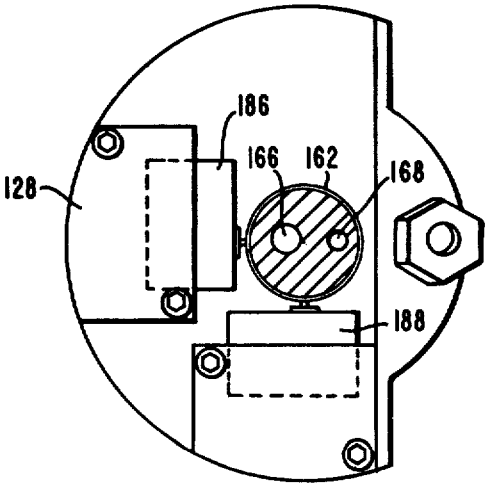
FIG. 13 is a bottom end view of a cam lock.

Referring now to FIGS. 8 and 13, a first sensor 186 is attached to central member 128 so as to be able to contact fourth slider member 162. A second sensor 188 is also attached to central member 128 but at ninety degrees around fourth slider member 162. When fourth slider member 162 is in the down position first sensor 186 contacts the normal diameter of fourth slider member 162 as shown in FIG. 8 while second sensor 188 is contacting first notch 190 in fourth slider member 162. However, when fourth slider member 162 is moved upwardly a short distance first sensor 186 will still contact the normal diameter of fourth slider member 162 as will second sensor 188 rather than first notch 190. When fourth slider member 162 is fully inserted, first sensor 186 will contact second notch 192 while second sensor 188 will still contact the normal diameter of fourth slider member 162. Thus, the sensors together can determine if fourth slider member 162 is fully down, partially inserted or fully inserted. The controls for the cam locks may be chosen from those well known in the art such as a rotary stepping switch from C. P. Clare and Co. of Chicago, Ill. and may be located in control box 56.

Figure 14:
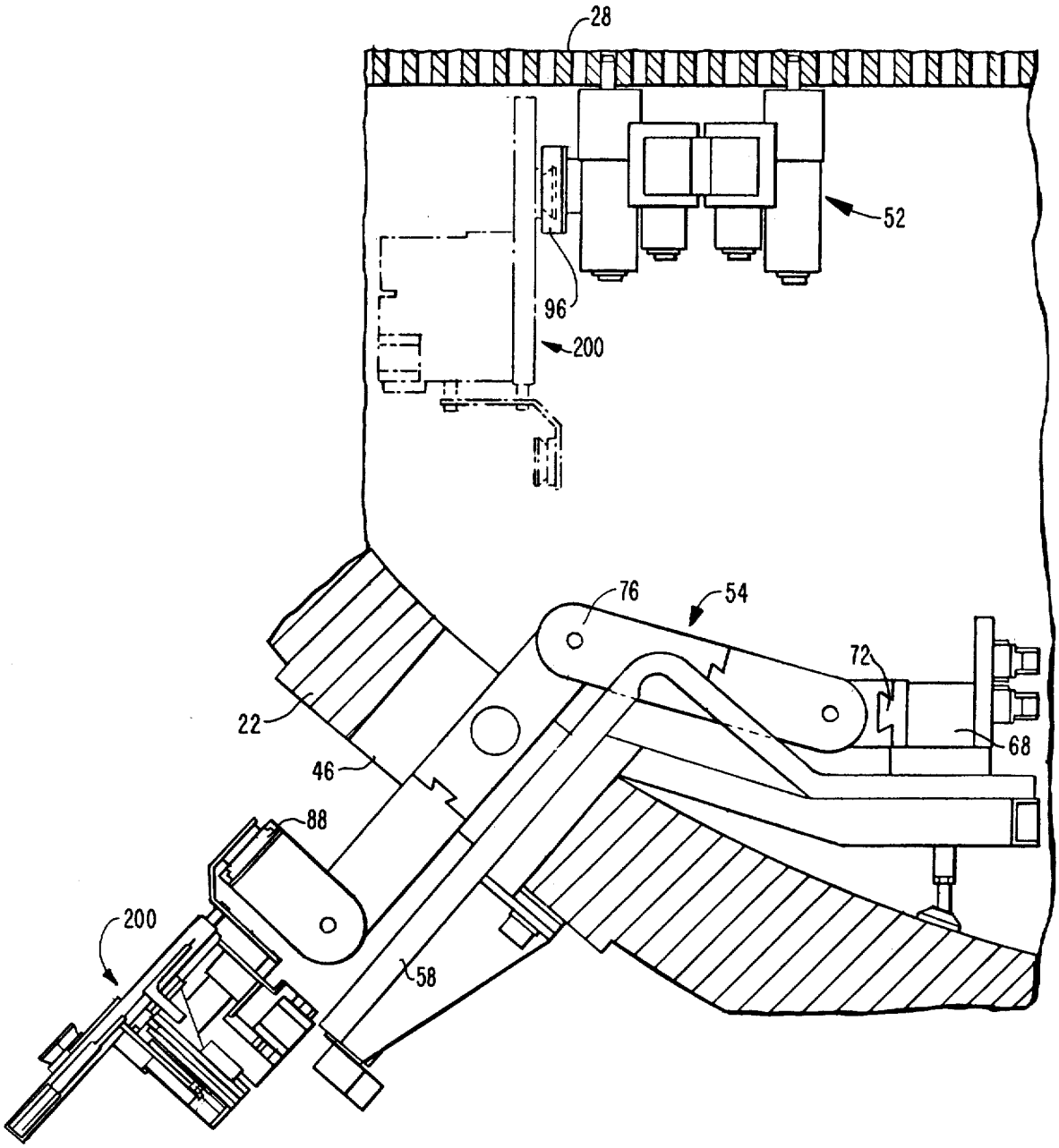
FIG. 14 is a partial cross-sectional view in elevation of the apparatus in a plenum of a steam generator.

Referring now to FIGS. 7 and 14, rather than having a single end effector such as a single tool attach to end effector attachment 96 it is possible to have a tool capable of many functions attach to end effector attachment 96 as shown in FIGS. 7 and 14. Such a tool that is capable of numerous functions is referred to generally as a multifunction end effector 200. Multi-function end effector 200 may be introduced into steam generator 20 in a manner similar to the introduction of slave carriage 52. For example, slave manipulator arm 54 is capable of grasping multi-function end effector 200 as shown in FIG. 14 and locating multi-function end effector 200 in contact with end effector attachment 96 of slave carriage 52 such that multi-function end effector 200 is attached to slave carriage 52 by means of end effector attachment 96 as shown in FIG. 14 in phantom and as shown in FIG. 7.

Figure 15:
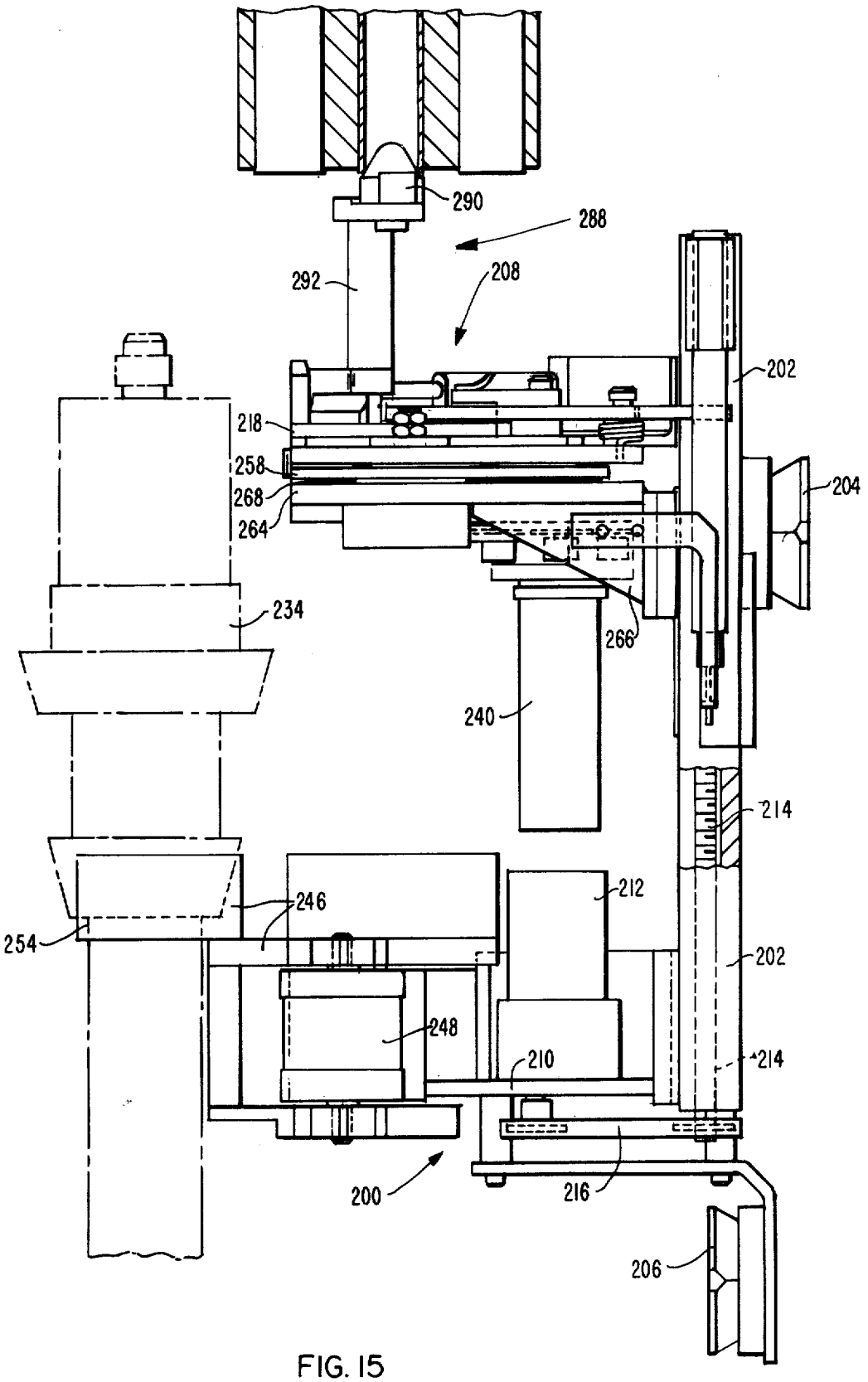
FIG. 15 is a partial cross-sectional view in elevation of the multi-function end effector.
Figure 16:
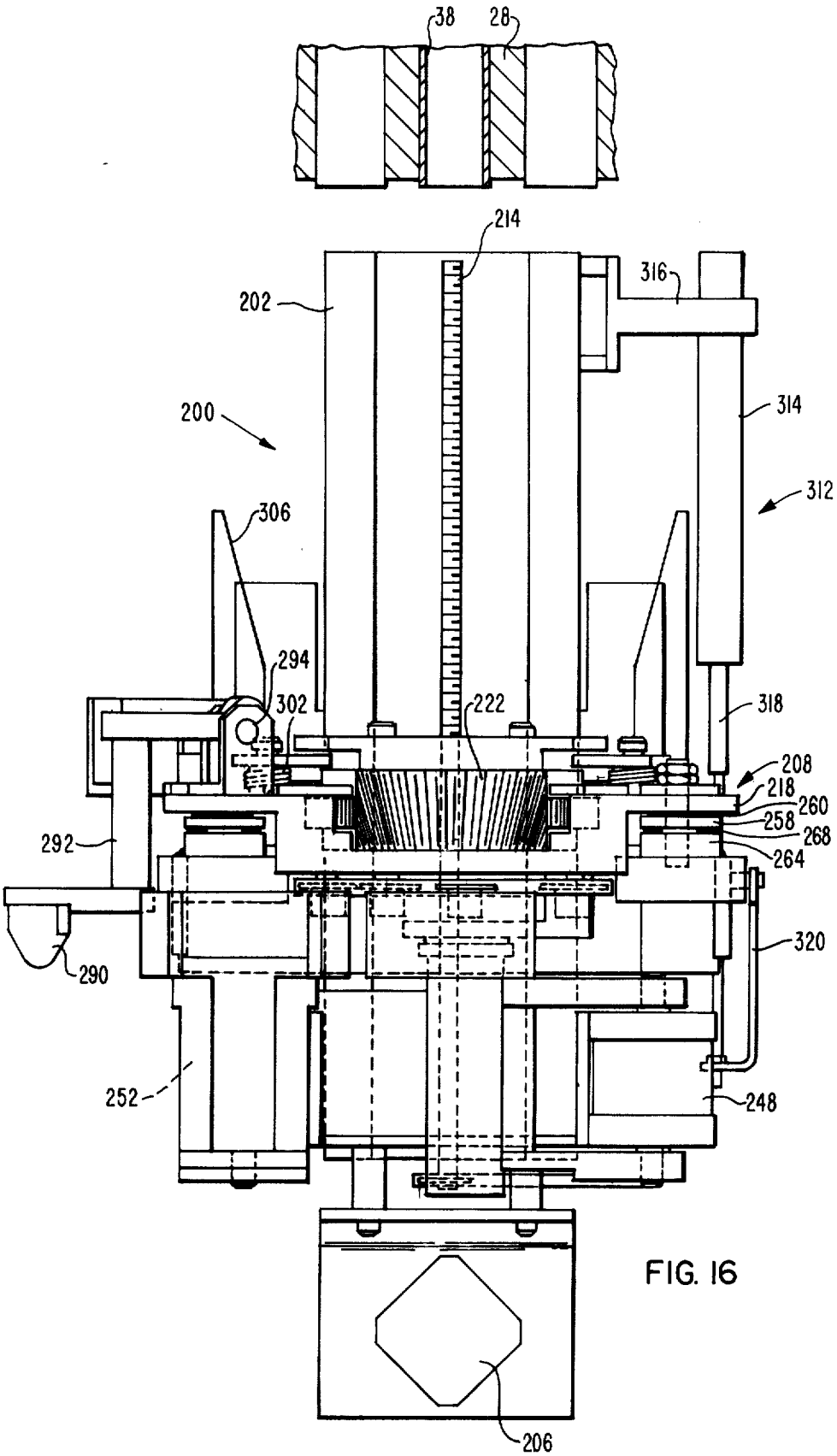
FIG. 16 is a front view in elevation of the multi-function end effector with the table lowered.
Figure 17:
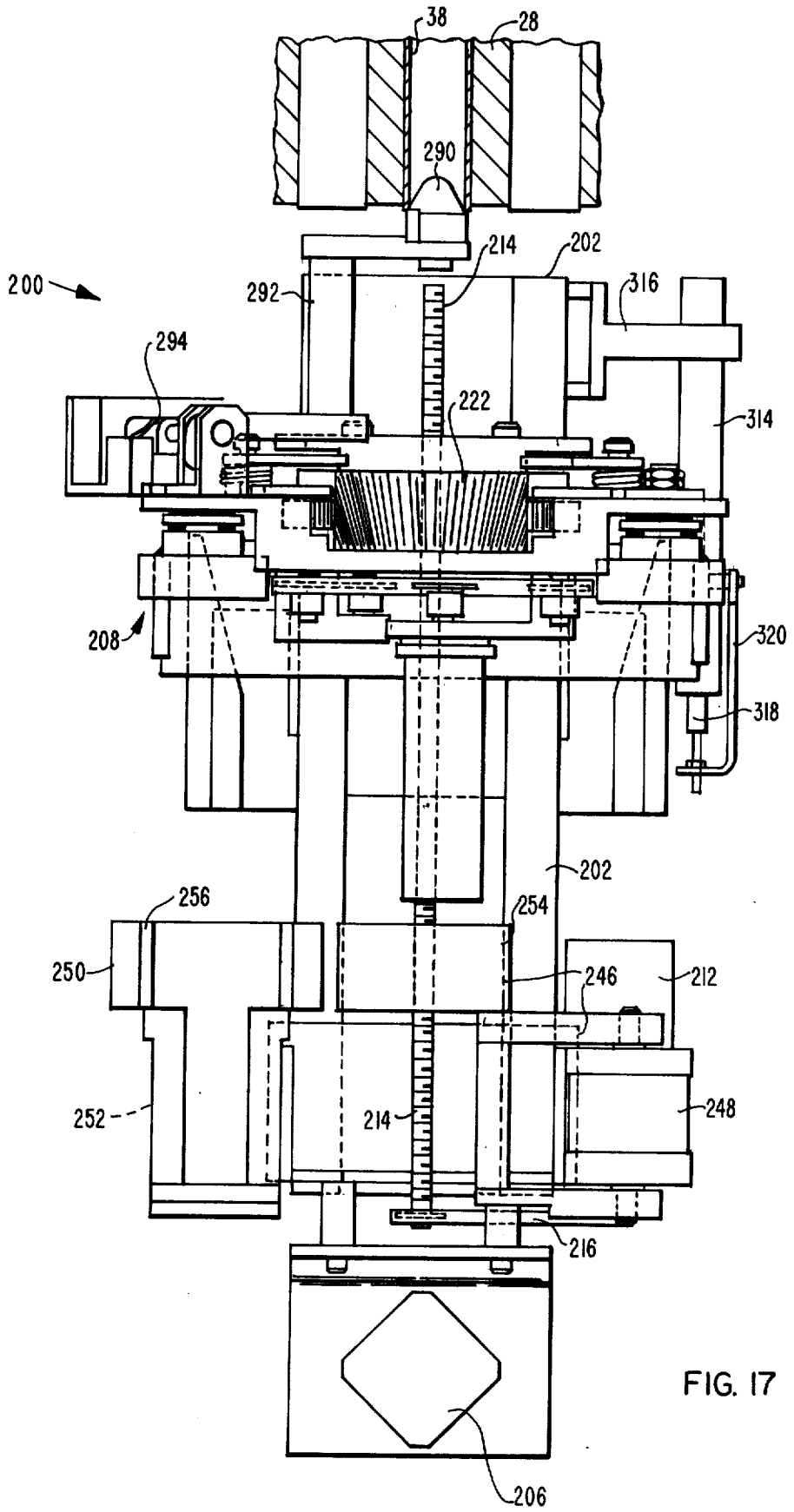
FIG. 17 is a front view in elevation of the multi-function end effector with the table raised.

Referring now to FIGS. 15, 16, and 17, multi-function end effector 200 comprises a vertical member 202 with a first attachment mechanism 204 attached near the top thereof and a second attachment mechanism 206 attached near the bottom end of vertical member 202. Attachment mechanisms 204 and 206 may be diamond-shaped attachment mechanisms and arranged so that various gripper mechanisms are capable of attaching thereto and supporting the weight of multi-function end effector 200. For example, second attachment mechanism 206 is provided such that gripper mechanism 88 of slave manipulator arm 54 is capable of grasping second attachment mechanism 206 and supporting the weight of multi-function end effector 200 for transporting multi-function end effector 200 into the steam generator 20. With gripper mechanism 88 attached to second attachment mechanism 206, slave manipulator arm 54 is capable of arranging multi-function end effector 200 near slave carriage 52 such that end effector attachment 96 is capable of grasping first attachment mechanism 204 to thereby support the weight of multi-function end effector 200 as shown in FIG. 14. With multi-function end effector 200 firmly attached to slave carriage 52 by means of first attachment mechanism 204, gripper mechanism 88 may be released from second attachment mechanism 206 so that multi-function end effector 200 is supported totally by slave carriage 52 as shown in phantom in FIG. 14. With slave manipulator arm 54 detached from multi-function end effector 200, slave manipulator arm 54 is capable of being extended through manway 46 for transferring various tools to multi-function end effector 200 so that multi-function end effector 200 may carry out inspection or repair operations on tube sheet 28. With a tool located in multi-function end effector 200, slave carriage 52 is capable of traversing tube sheet 28 so as to place multi-function end effector 200 with the tool mounted therein in proper relationship to tube sheet 28 so that operations may be performed on tube sheet 28. The movement of slave carriage 52 with multi-function end effector 200 attached thereto is similar to the movement of slave carriage 52 which has been described previously.

Referring again to FIGS. 15, 16, and 17, vertical member 202 has a substantially horizontal table 208 attached thereto and in a manner such that table 208 is capable of moving vertically relative to vertical member 202. A lower support plate 210 is firmly attached to the lower end of vertical member 202 for supporting various components. A first drive mechanism 212 is supported by lower support plate 210 and couples to a vertical lead screw 214 disposed in vertical member 202 by means of first drive belt 216. Lead screw 214 is in turn attached to table 208. When first drive mechanism 212 is activated, it causes first drive belt 216 to turn lead screw 214 which causes table 208 to move vertically relative to vertical member 202 in a manner well understood by those skilled in the art.

Figure 18:
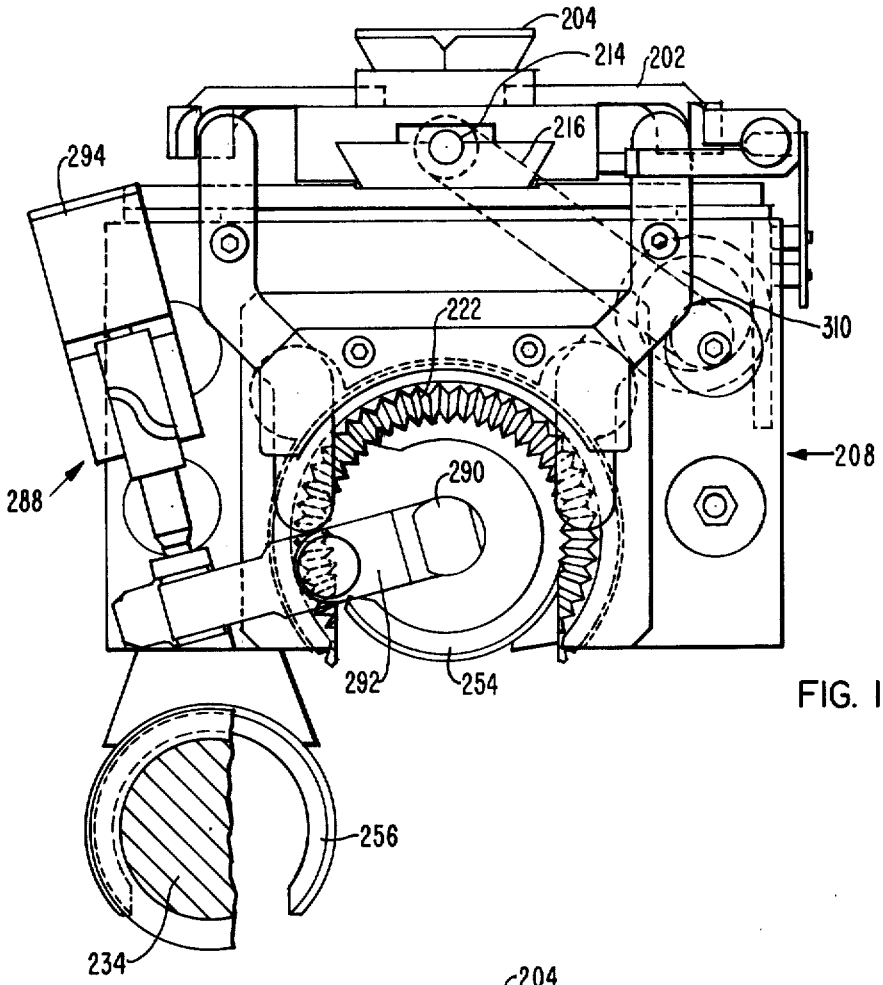
FIG. 18 is a plan view of the multi-function end effector.
Figure 19:
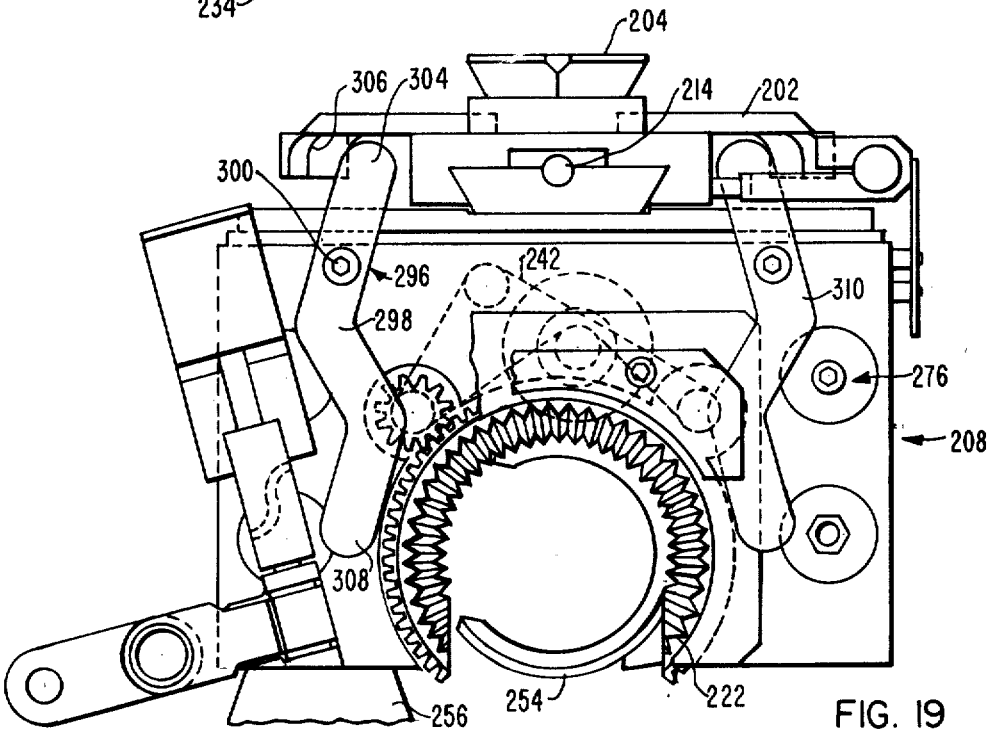
FIG. 19 is a plan view of the multi-function end effector.
Figure 20:
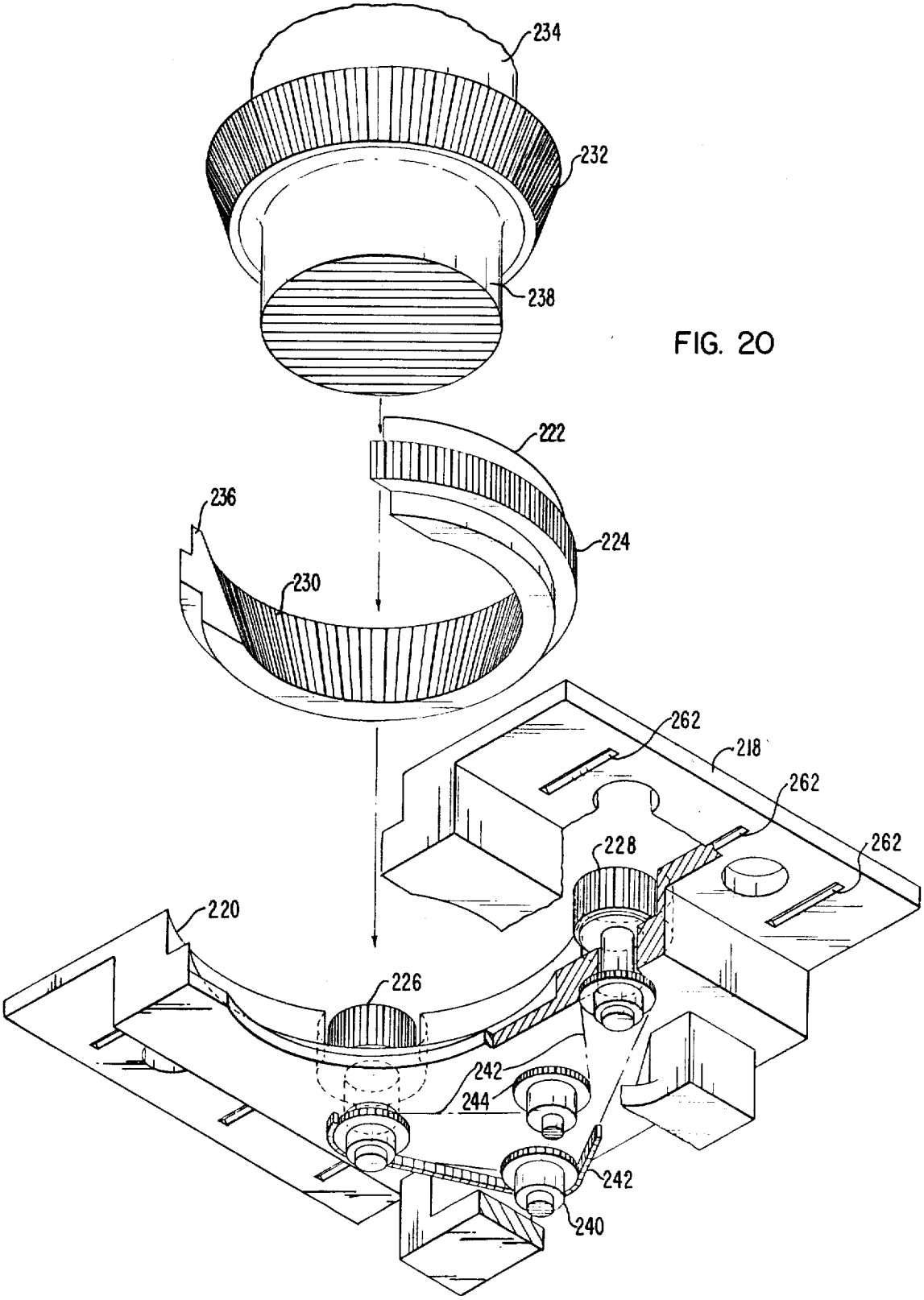
FIG. 20 is an exploded view of the table of the multi-function end effector.

Referring now to FIGS. 15–21, table 208 comprises a first plate 218 with a substantially crescent-shaped hole 220 cut therein. A first beveled gear 222 is disposed in crescent-shaped hole 220 such that first teeth 224 of first beveled gear 222 are capable of engaging first gear 226 and second gear 228 which are both disposed in first plate 218. First beveled gear 222 has a second set of teeth 230 on the inside thereof that are beveled such that the lower end of first beveled gear 222 has a smaller diameter than the upper end of first beveled gear 222 which permits a tool with a similar configuration to be disposed therein. Second teeth 230 are provided for engaging a complementary third set of teeth 232 which are disposed on a tool 234 for use with multi-function end effector 200. First beveled gear 222 is also formed in a crescent configuration such that it has a crescent-shaped opening 236 therein for accommodating the insertion of a tool such as tool 234. Tools to be used with multi-function end effector 200 are constructed such that they have a stem 238 that is smaller in diameter than the smallest diameter of first beveled gear 222 so that stem 238 may be shifted horizontally through crescent-shaped opening 236 while third teeth 232 are located above first beveled gear 222. Once stem 238 has been disposed in colinear alignment with the vertical centerline of first beveled gear 222 and above first beveled gear 222, table 208 and first beveled gear 222 may be moved upwardly such that third teeth 232 engage second teeth 230. First gear 226 and second gear 228 are disposed in first plate 218 at a distance around the circumference of crescent-shaped hole 220 that is less than the length of crescent-shaped opening 236 such that either first gear 226 or second gear 228 is always in contact with first beveled gear 222, thereby providing a continuous drive mechanism for first beveled gear 222. Both first gear 226 and second gear 228 extend through first plate 218 and are connected to second drive mechanism 240 by means of second drive belt 242 as shown in FIG. 20. Second drive belt 242 is also connected to a third gear 244 which is attached to the bottom of first plate 218 and serves to direct second drive belt 242 so that second drive belt 242 does not interfere with the lower portion of tool 234 that extends through table 208 such as stem 238. When activated, second drive mechanism 240 causes second drive belt 242 to turn first gear 226 and second gear 228 which causes first beveled gear 222 to turn within crescent-shaped groove 220. In addition, when a tool such as tool 234 is inserted in first beveled gear 222, second drive mechanism 240 can also rotate tool 234 with respect to table 208 since tool 234 is engaged with first beveled gear 222 by means of third teeth 232. In this manner, second drive mechanism 240 is capable of serving as the drive mechanism for tool 234 such as when tool 234 is a rotational welding device. Also, second drive mechanism 240 can serve to rotationally position the tool 234 with respect to tube sheet 28.

Still referring to FIGS. 15–21, multi-function end effector 200 also comprises a first transfer arm 246 which is attached to first transfer arm drive mechanism 248 which in turn is mounted on lower support plate 210. Likewise, a second transfer arm 250 is attached to second transfer arm drive mechanism 252 which is also mounted on lower support plate 210. First transfer arm 246 has a crescent-shaped first holder 254 attached to the end thereof for receiving a tool such as tool 234 that has been transferred from slave manipulator arm 54. Likewise, second transfer arm 250 has a second holder 256 on the end thereof. Both first transfer arm 246 and second transfer arm 250 are capable of being rotated in a horizontal plane by means of transfer arm drive mechanism 248 and 252 so as to be able to transfer a tool from first holders 254 or 256 into first beveled gear 222. Two transfer arms 246 and 250 are provided so that one arm may remove a tool from table 208 while the other may have a tool mounted therein for transfer to table 208.

Figure 21:
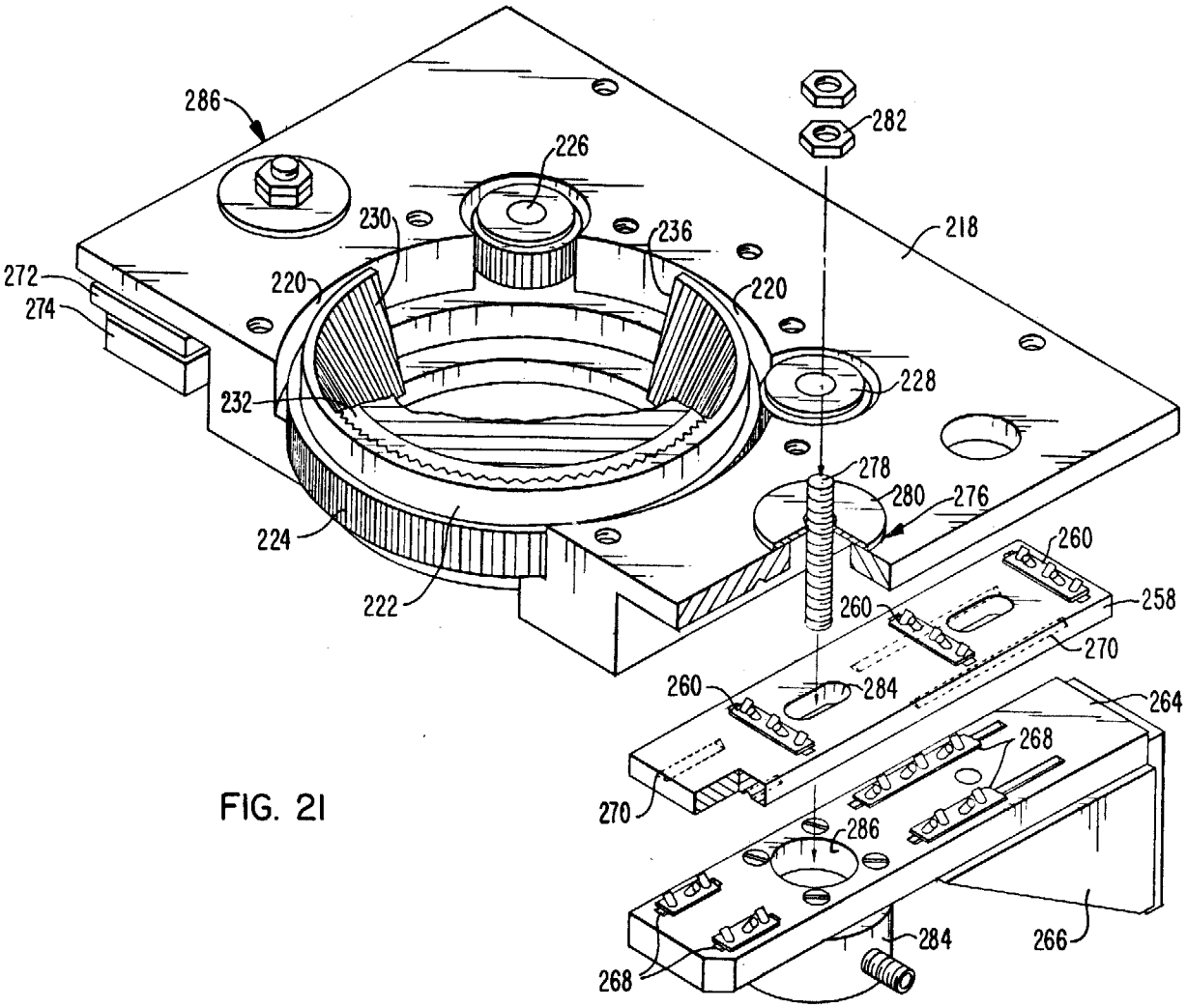
FIG. 21 is an exploded view of the table of the multi-function end effector.

Referring now particularly to FIGS. 20 and 21, Table 208 also comprises a second plate 258 disposed below first plate 218 with a first set of bearing mechanisms 260 mounted thereon which are capable of fitting into first bearing slots 262 in first plate 218. First bearing mechanisms 260, which may be a caged-crossed roller bearing, chosen from those well known in the art enables second plate 258 to slide relative to first plate 218 and along first bearing grooves 262. In addition, a third plate 264 is disposed under second plate 258 and attached to lead screw 214 by means of struts 266. Third plate 264 has a second set of bearing mechanisms 268 mounted thereon which are similar to first bearing mechanism 260 and are capable of being inserted into second bearing slots 270 which are cut in second plate 258. Second bearing slots 270 are cut in second plate 258 so as to run in a direction perpendicular to first bearing mechanisms 260. Similarly, a fourth plate 272 and a fifth plate 274 having bearing mechanisms similar to first bearing mechanisms 260 and second bearing mechanism 268 are attached to first plate 218 on the opposite side thereof. Second plate 258, third plate 264, fourth plate 274, and fifth plate 274 along with their associated bearing mechanisms provide a mechanism by which first plate 218 with a tool mounted therein is capable of sliding in two perpendicular directions so as to align the center of the tool with a particular tube in tube sheet 28.

Multi-function end effector 200 also comprises a locking mechanism referred to generally by the reference numeral 276. Locking mechanism 276 comprises a first bolt 278 with a first spacer 280 mounted above first plate 218 and near the top end of first bolt 278 and with a first nut 282 attached to the top thereof. First bolt 278 extends through first plate 218, through first slot 284 in second plate 258 and through a second slot 286 in third plate 264. The bottom end of first bolt 278 is attached to a first air cylinder 284 which may be chosen from those well known in the art. In addition, a similar locking device 286 is located on the opposite side of first plate 218 and connects first plate 218, fourth plate 272, and fifth plate 274. When first plate 218 and the tool 234 has been centered in relationship to the proper tube in tube sheet 28 by means of the bearing mechanisms and the slidings of the various plates, first plate 218 may be anchored by the locking mechanisms 276 and 286. The locking of locking mechanism 276 may be accomplished by activating first air cylinder 284 which causes first bolt 278 to be drawn downwardly and in turn causes first plate 218 to be drawn into close contact with second plate 258 and which causes second plate 258 to be drawn into close contact with third plate 264. In this manner, first plate 218 is locked such that it will not move horizontally relative to vertical support 202. When it is desired to reposition tool 234 or first plate 218, first air cylinder 284 may be deactivated which allows the plates to slide relative to each other as previously described.

Multi-function end effector 200 also comprises a piloting mechanism 288 which is mounted on one side of first plate 218. Pilot mechanism 288 comprises a cap 290 which is capable of being inserted into a chosen tube 38 in tube sheet 28. Cap 290 is attached to linkage 292 which in turn is attached to pivoting mechanism 294 which is mounted on the top of first plate 218. Pivoting mechanism 294 is capable of pivoting linkage 292 and cap 290 in a clockwise or counterclockwise direction so as to rotate cap 290 to the side of first plate 218 as shown in FIG. 16 or into alignment with a tube 38 as shown in FIG. 15. When it is desired to center a tool which has been mounted on first plate 218 pivoting mechanism 294 is activated such that cap 290 and linkage 292 are rotated into a position in colinear alignment with a chosen tube 38 but lower than the tube 38. When in this position, first drive mechanism 212 may be activated so as to raise table 208 and first plate 218 toward tube sheet 28 which causes cap 290 to be inserted into a particular tube 38 as shown in FIG. 17. Since cap 290 has a conical shape it is capable of being inserted into a tube 38 without being in exact colinear alignment with the centerline of tube 38. However, cap 290 and linkage 292 are arranged such that when cap 290 has been rotated into a position as shown in FIG. 17, cap 290 is directly in the center of first beveled gear 222. When in this configuration, and with locking mechanisms 276 and 286 in an unlocked situation, as cap 290 is being inserted into a particular tube 38 first plate 218 which is attached to pilot mechanism 288 is permitted to shift by means of bearing mechanisms 260 and 268 such that first plate 218 and first beveled gear 222 become aligned with the exact centerline of the chosen tube 38 as shown in FIG. 17. Therefore, pilot mechanism 288 provides a mechanism by which first beveled gear 222 may be aligned with the particular tube 38 by the action of the sliding of the various plates as described above. Once first beveled gear 222 has been centered with the particular tube 38, locking mechanisms 276 and 286 may be activated which locks first plate 218 and first beveled gear 222 in the particular horizontal location. At this point table 208 may be lowered by activating first drive mechanism 212 so that cap 290 and the linkage 292 may be rotated to the side of first table 218 as shown in FIG. 16. Since first plate 218 has been locked in a particular position in colinear alignment with the tube 38, table 208 with tool 234 disposed therein may be again raised vertically so as to bring the particular tool into contact with the chosen tube 38 without misaligning the particular tool.

Multi-function end effector 200 also comprises a latching mechanism 296. Latching mechanism 296 comprises a first bar 298 as shown in FIGS. 18 and 19. Latching mechanism 296 also comprises a pin 300 which is pivotally attached to first bar 298 and to first plate 218. In addition, latching mechanism 296 also comprises a first biasing mechanism 302 which may be a coil spring as shown in FIG. 16 and serves to urge first end 304 of bar 298 against camming surface 306. Camming surface 306 is also attached to vertical member 202 and serves to guide second end 308 of first bar 298 over the edge of first beveled gear 222 as table 208 is moved vertically towards tube sheet 28. On the other hand, camming surface 306 also causes second end 308 to be moved clear of first beveled gear 222 when table 208 is in the lowered position. Latching mechanism 296 provides a device that is capable of preventing tool 234 from becoming dislodged from first beveled gear 222 as table 208 is being moved vertically. This is accomplished by having second end 308 disposed over first beveled gear 222 and tool 234 as shown in FIG. 18 when table 208 is raised vertically. On the other hand, when table 208 is in the lowered position relative to vertical member 202, latching mechanism 296 is in a position as shown in FIG. 19 which is clear of tool 234 so that a tool may be removed or inserted in first beveled gear 222. In addition, a second latching mechanism 310, which is similar to latching mechanism 296 is also provided.

Referring now to FIGS. 16 and 17, multi-function end effector 200 further comprises a position indicating mechanism 312 which may be a linear variable differential transformer chosen from those well known in the art. Position indicating mechanism 312 comprises a transforming mechanism 314 attached to vertical member 202 by support 316 and a variable armature 318 slidably disposed within transforming mechanism 314 and extending from the bottom end thereof. Armature 318 is in turn connected to table 208 by connector 320. As table 208 is moved vertically, armature 318 is moved relative to transforming mechanism 314 by means of its connection to table 208. The relative movement of armature 318 with respect to transforming mechanism 314 may be translated into a reading that indicates the position of table 208 relative to vertical member 202. In this manner, the position of a tool mounted on table 208 may be determined with respect to tube sheet 28 and vertical member 202.

Controls for multi-function end effector 200 may be chosen from those well known in the art. In addition, electrical conduits extend from multi-function end effector 200 to control devices located outside the steam generator so that multi-function end effector 200 may be remotely controlled.

Figure 22:
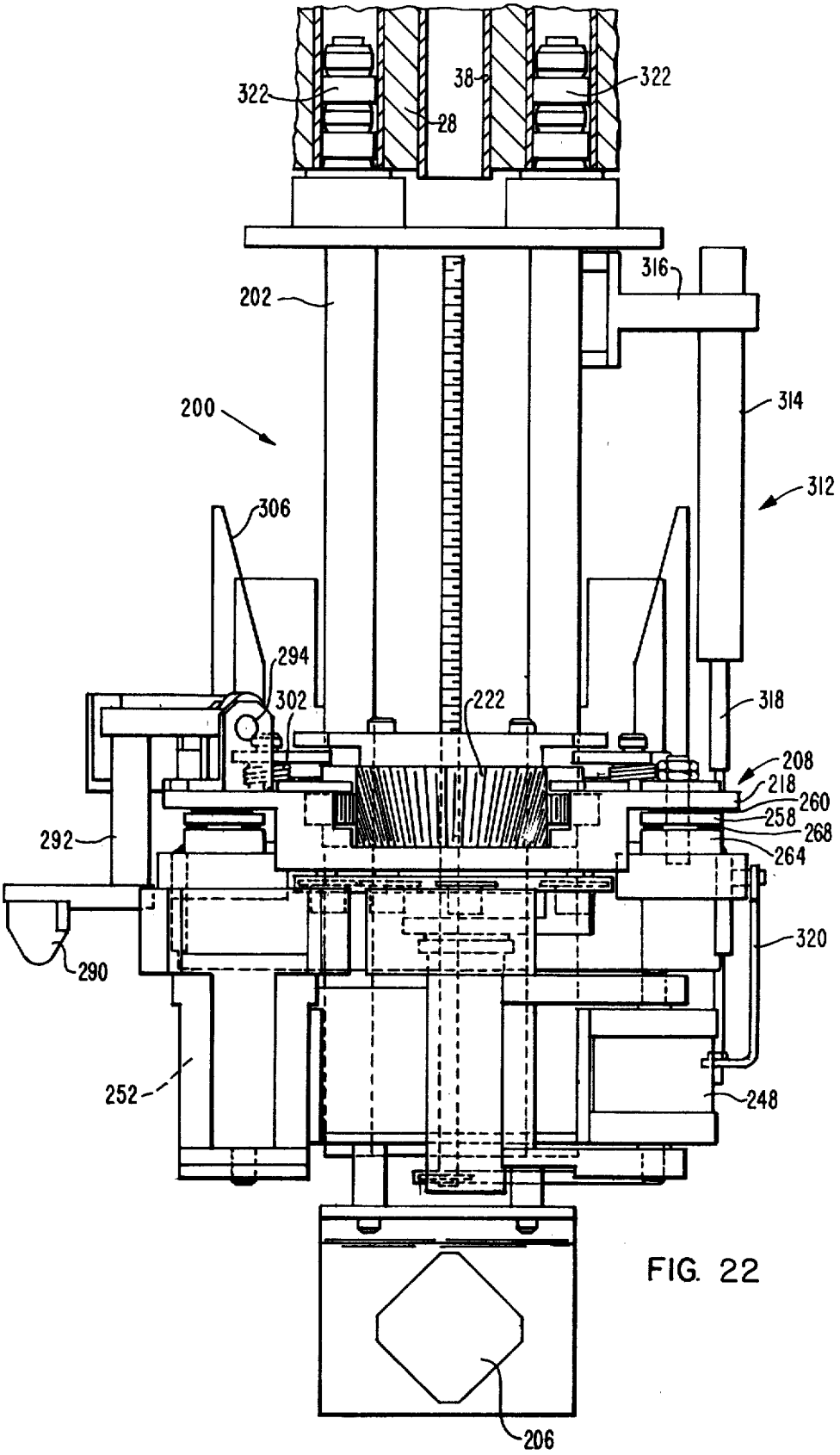
FIG. 22 is an alternate embodiment of the multi-function end effector.

Referring to FIG. 22, as an alternative to the embodiment described above, vertical member 202 may have cam locks 322 which may be similar to cam locks previously described attached to its upper end such that multi-function end effector 200 may be used independent of slave carriage 52. In this embodiment, slave manipulator arm 54 locates multi-function end effector 200 near tube sheet 28 so that cam locks 322 are capable of engaging tubes 38 thereby supporting multi-function end effector 200.

OPERATION

When it is desired to inspect or repair a nuclear steam generator, the steam generator primary fluid inlet and outlet plena are drained and a manway is opened giving access to one of the plena. The slave track 58 is then introduced through manway 46 and bolted into place. Slave manipulator arm 54 is then assembled on the portion of track 58 that extends out of steam generator 20. Next slave manipulator arm 54 is cranked into the steam generator along track 58 by means of a chain. At this point the master manipulator arm 50 is coordinated with slave manipulator arm 54 so that the position of master manipulator arm 50 on the scale model corresponds to the position of slave manipulator arm 54 in steam generator 20. Of course, the scale model is positioned upside down with respect to the steam generator as shown in FIG. 2 so that the operator may have better access to the scale model. Master manipulator arm 50 is then manually moved by the operator into any desired position which results in slave manipulator arm 54 being similarly positioned. Next, master carriage 48 is attached to master manipulator arm 50 and slave carriage 52 is attached to slave manipulator arm 54 as shown in FIG. 3. Master manipulator arm 50 is then moved so that master carriage 48 is plugged into the scale model of the tube sheet which results in slave manipulator arm 54 and slave carriage 52 attaining the position as indicated in FIG. 4. The cam locks of master carriage 48 are then manually locked into the scale model of the tube sheet which causes the cam locks of slave carriage 52 to also become locked into the tube sheet 28. At this point, the manipulator arms (both the master and the slave) are disconnected from the carriages, and are extended outwardly through manway 46 where multi-function end effector 200 is attached to the end of slave manipulator arm 54 by gripper mechanism 88 while a scale model of the multi-function end effector 200 is attached to master manipulator arm 50. The slave manipulator arm 54 is then caused to attach the multi-function end effector 200 to end effector attachment 96 and release the multi-function end effector 200 from gripper mechanism 88. In so doing, multi-function end effector 200 is mechanically handed through manway 46 to slave carriage 52 without operator exposure to the irradiated interior of steam generator 20. In this position, slave carriage 52 may then traverse tube sheet 28 so as to place multi-function end effector 200 in proper relationship with a chosen location of tube sheet 28. At this point all cam locks are in a locked position as shown in FIG. 11 but with first annular chamber 146 closed.

Once the multi-function end effector 200 has been attached to slave carriage 52 as shown in FIG. 7 and as shown in FIG. 14 in phantom, it is then necessary to align the vertical centerline of first beveled gear 222 with the chosen tube 38 in tube sheet 28. At this point table 208 is lowered into a position as shown in FIG. 16 and piloting mechanism 288 is rotated in a counterclockwise rotation such that cap 290 is in substantial alignment with the chosen tube 38. With cap 290 in substantial alignment with the chosen tube 38, table 208 is raised vertically by means of first drive mechanism 212 such that cap 290 is inserted into the chosen tube 38. As cap 290 is inserted into the chosen tube 38, first plate 218 of table 208 is caused to slide relative to second plate 258 and third plate 264 as previously described until the centerline of first beveled gear 222 is in colinear alignment with the chosen tube 38. At this point locking mechanisms 276 and 286 are activated which locks first plate 218 and first beveled gear 222 into colinear alignment with the chosen tube 38. When so locked in alignment, table 208 is lowered by means of first drive mechanism 212 until it is possible to rotate piloting mechanism 288 in a counterclockwise direction until piloting mechanism 288 is in a position as shown in FIG. 16.

With first beveled gear 222 locked in colinear alignment with the chosen tube 38, it is necessary to transfer a chosen tool 234 into first beveled gear 222 so that work may be performed on the chosen tube 38. In order to accomplish this, second drive mechanism 240 is activated which causes first beveled gear 222 to be rotated until crescent-shaped opening 236 of first beveled gear 222 is in alignment with crescent-shaped hole 220 so that a tool 234 may be inserted therethrough. Next, first transfer arm 246 is rotated away from table 208 by means of first transfer arm drive mechanism 248 until first transfer arm 246 is in a position as shown in FIG. 15. Likewise, second transfer arm 250 is also rotated away from table 208 by means of second transfer arm drive mechanism 252 until second transfer arm 250 is in a position as shown in FIG. 18. Table 208 is moved to its lowermost position with respect to vertical member 202 such that latching mechanism 296 and second latching mechanism 310 are in a position clear of first beveled gear 222 as shown in FIG. 19. Slave manipulator arm 54 then transfers a chosen tool 234 into one of the transfer arms as shown in FIGS. 15 or 18. When in this position stem 238 of tool 234 extend through the same plane as crescent-shaped hole 220 and third teeth 232 are located above first beveled gear 222. The transfer arm with the tool disposed therein is then rotated in the horizontal plane so that stem 238 passes through crescent-shaped opening 236 and into the center of first beveled gear 222 with third teeth 232 disposed above second teeth 230. At this point, table 208 is raised vertically by means of first drive mechanism 212 until first beveled gear 222 contacts third teeth 232 and raises tool 234 out of contact with the transfer arm within which the tool was disposed. As table 208 continues to be raised relative to vertical member 202 the latching mechanism 296 and 310 are cammed by camming surface 306 which causes the latching mechanisms to lock the tool 234 into close contact with first beveled gear 222 as previously described. When so locked into position, table 208 may be raised until tool 234 contacts the chosen tube 38 so that operations may be performed on the tube 38. Of course, second drive mechanism 240 may also rotate first beveled gear 222 and tool 234 disposed therein so as to rotationally position the tool 234 with respect to tube 38. On the other hand, if the chosen tool 234 is self-powered, use of second drive mechanism 240 may not be necessary. Once the operation has been performed on the chosen tube 38, table 208 may be lowered such that tool 234 is clear of tubes 38 and tube sheet 28. Next, a different tool may be inserted into the multi-function end effector 200 so that a different operation may be performed on the same tube 38 or slave carriage 52 may be moved as previously described so that multi-function end effector 200 with tool 234 disposed therein may be transferred to a different location for performing operations on a different tube 38.

In order to traverse tube sheet 28 it is necessary to withdraw one cam lock as shown in FIG. 8 so that the withdrawn cam lock can be moved as indicated in FIG. 7. Because of the rotatability of the members of slave carriage 52 any cam lock may be withdrawn and moved as long as the other two cam locks are locked in place thus suspending slave carriage 52 from tube sheet 28. The cam lock of master carriage 48 that has been withdrawn is then positioned over the selected tube and manually inserted, this causes the corresponding slave cam lock to function as follows.

Referring to FIGS. 8 and 9, air is introduced into third annular chamber 172 which causes second slider member 142, third slider member 152, and fourth slider member 162 to move upwardly toward tube sheet 28 as shown in FIG. 9. As second slider member 142 moves upwardly second ledge 150 contacts first ledge 140 which causes first slider member 134 to contact tube sheet 28 around the chosen tube 38 as shown in FIG. 10. In this position, third slider member 152 has been inserted into tube 38. Then oil is introduced under pressure into second annular chamber 164 which forces fourth slider member 162 downwardly with respect to second slider member 142. Since third slider member 152 is attached to fourth slider member 162, third slider member 152 is also forced downwardly with respect to tube sheet 28 and second slider member 142. The downward motion of third slider member 152 causes the beveled edges of cap 156 and spacer 154 to contact first metal ring 158 and second metal ring 160 thereby causing the rings to expand and contact the inner side to tube 38 thus locking itself in place as shown in FIGS. 11 and 12. Withdrawal of a cam lock may be done by reversing this procedure.

Since each tube 38 may have slightly different alignment with respect to other such tubes 38, it is desirable to be able to align each cam lock with the tube 38 in which it has been inserted. To thus align the locked cam lock, oil is introduced into fourth annular chamber 182 which forces beveled head 180 against inner housing 126. The beveled sides of beveled head 180 together with the corresponding sides of inner housing 126 causes inner housing 126 to shift into alignment with third slider member 152 which is in alignment with tube 38 into which it has been inserted. Of course, third biasing mechanism 184 will return fifth slider member 178 to its lowered position upon release of the air from fourth annular chamber 182. In this manner any cam lock may be locked into any open tube 38. By moving one cam lock at a time as described above and then another cam lock in the same manner, slave carriage 52 can be made to traverse the entire tube sheet 28. Furthermore, the rotatability of the joints of slave carriage 52 enables slave carriage 52 to move in any direction and enables it to skip a tube 38 that may be plugged. Such movements of slave carriage 52 are used to position tools that have been attached to one effector attachment 96 so that operations may be performed in the steam generator.

Because there exists a certain amount of slack or looseness among the members of slave carriage 52 and because slave carriage 52 is suspended beneath tube sheet 28, gravity tends to cause the members of slave carriage 52 to sag in relationship to tube sheet 28. As slave carriage 52 traverses the tube sheet this sagging of the members could accumulate to the point where the cam locks of slave carriage 52 would no longer be able to engage a tube 38 which would result in the carriage falling from the tube sheet. To avoid this problem it is advisable to have a mechanism whereby the sag of slave carriage 52 is eliminated after each move thus maintaining the carriage at a constant distance from tube sheet 28. The invention described herein is capable of eliminating this problem. With two cam locks locked in place, the third cam lock is withdrawn and moved to a new position. At this point, air is introduced into third annular chamber 172 of the third cam lock which causes third slider member 152 to be inserted as previously described. Then the air is released from third annular chamber 172 of both of the other cam locks while air is introduced into both first annular chambers 146 of these two cam locks. Since the oil pressure in the second annular chambers 164 of both of these cam locks is greater than the air pressure in their first annular chambers 146 and since the friction force on rings 158 and 160 is sufficient to hold third slider member 152 in place, the introduction of air into first annular chambers 142 causes central member 128 to be raised rather than third slider member 152 to be withdrawn. The raising of central member 128 also causes inner housing 126 and outer housing 122 to be raised relative to tube sheet 28. Since this is occurring on the two locked cam locks the effect is to raise slave carriage 52 relative to tube sheet 28. Next, oil is introduced into second annular chamber 164 to lock it in place. Then air is introduced into third annular chamber 172 of all three cam locks which causes central member 128 to be moved downwardly with respect to third slider member 152 which causes the bottom portion of cup member 130 to contact second slider member 142 thus eliminating first annular chamber 146. In this manner, the cumulative sag among members is avoided. Therefore, the invention provides a multi-function end effector that is capable of positoning tools in relation to equipment so that operations may be performed on the equipment. The invention also provides a multi-function end effector that is capable of being transported by a remote access manipulator.

I claim as my invention:

1. A multi-function end effector for performing operations on equipment comprising:

a vertical member capable of being disposed in said equipment;

centering means attached to said vertical member and having plates capable of relative horizontal motion;

tool holding means with a crescent-shaped gear for holding tools and mounted on said centering means for supporting said tools in relation to said equipment for performing operations on said equipment; and vertical drive means attached to said vertical member and to said centering means for vertically moving said tool holding means relative to said vertical member thereby vertically positioning said tools relative to said equipment, said centering means horizontally positioning said tools by movement of said plates.

2. The multi-function end effector according to claim 1 wherein said multi-function end effector further comprises:

pilot means attached to said centering means for guiding said centering means into alignment with said equipment; said centering means reacting to said pilot means for properly aligning said tools relative to said equipment.

3. The multi-function end effector according to claim 2 wherein said multi-function end effector further comprises tool transfer means attached to said vertical member for transferring said tools to said tool holding means.

4. The multi-function end effector according to claim 3 wherein said multi-function end effector further comprises tool latching means disposed on said centering means for securing said tools in said tool holding means.

5. The multi-function end effector according to claim 4 wherein said multi-function end effector further comprises position indicating means attached to said vertical member and to said centering means for indicating the vertical position of said tool holding means with respect to said vertical member.

6. The multi-function end effector according to claim 2 wherein said centering means comprises:

a first plate attached to said pilot means and having said tool holding means disposed therein and having first bearing slots disposed therein;

a second plate capable of movement relative to said first plate and disposed below said first plate and having second bearing slots disposed therein that are substantially perpendicular to said first bearing slots;

a third plate capable of movement relative to said first and second plates and disposed below said second plate and attached to said vertical drive means;

a first set of bearing mechanisms disposed on said second plate and in said first bearing slots for permitting said second plate to slide relative to said first plate; and a second set of bearing mechanisms disposed on said third plate and in said second bearing slots for permitting said third plate to slide relative to said second plate, said first and second plates sliding relative to said third plate under the influence of said pilot means.

7. The multi-function end effector according to claim 6 wherein said centering means further comprises:

a bolt with a first end attached to said first plate and extending through said second plate with a second end extending through said third plate; and an actuator attached to said third plate and to said second end of said bolt for selectively drawing said plates into close contact thereby preventing relative movement of said plates.

8. The multi-function end effector according to claim 7 wherein said actuator is an air cylinder.

9. The multi-function end effector according to claim 1 wherein said tool holding means comprises:

said crescent-shaped gear disposed in a crescent-shaped hole in said centering means for holding said tools therein;

a first gear mounted on said centering means and in contact with said crescent-shaped gear;

a second gear mounted on said centering means and in contact with said crescent-shaped gear such that either said first gear or said second gear is in contact with said crescent-shaped gear; and a gear drive means attached to said first and second gears for driving said crescent-shaped gear and tools mounted therein.

10. The multi-function end effector according to claim 1 wherein said vertical drive means comprises a lead screw mounted in said vertical member and in contact with said centering means and a drive mechanism connected to said lead screw for turning lead screw and moving said centering means vertically relative to said vertical member.

11. The multi-function end effector according to claim 2 wherein said pilot means comprises:

a pivoting mechanism mounted on said centering means; and a linkage having a conical cap on one end and attached to said pivoting mechanism at the other end for guiding said tools into alignment with said equipment.

12. The multi-function end effector according to claim 3 wherein said tool trasfer means comprises:

a transfer arm drive mechanism associated with said vertical member;

a transfer arm attached to said transfer arm drive mechanism; and a crescent-shaped holder attached to said transfer arm for holding tools, said transfer arm drive mechanism being capable of rotating said transfer arm and said holder in a horizontal plane thereby enabling said tools to be transferred to said holding means.

13. The multi-function end effector according to claim 4 wherein said tool latching means comprises:

a bar pivotally mounted on said centering means;

a camming surface mounted on said vertical member; and biasing means attached to said bar for urging one end of said bar into contact with said camming surface with said camming surface causing the other end of said bar to be selectively positioned over said tool and said tool holding means thereby selectively securing said tool in said tool holding means.

14. The multi-function end effector according to claim 5 wherein said indicating means comprises a linear variable differential transformer.

* * * * *